US010883506B2

(12) United States Patent
Eslinger et al.

(10) Patent No.: US 10,883,506 B2
(45) Date of Patent: Jan. 5, 2021

(54) UNITARY THICK DIAMOND COMPOSITE DOWNHOLE TOOL COMPONENTS

(71) Applicant: Schlumberger Technology Corporation, Sugar Land, TX (US)

(72) Inventors: David Milton Eslinger, Collinsville, OK (US); Spyridon Joseph Kotsonis, Missouri City, TX (US); David Hoyle, Salt Lake City, UT (US); Alejandro Camacho Cardenas, Houston, TX (US); Arthur Watson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 322 days.

(21) Appl. No.: 15/591,861

(22) Filed: May 10, 2017

(65) Prior Publication Data

US 2018/0328365 A1 Nov. 15, 2018

(51) Int. Cl.

| | |
|---|---|
| ***F04D 13/08*** | (2006.01) |
| ***E21B 43/12*** | (2006.01) |
| ***F04D 29/047*** | (2006.01) |
| ***F04D 29/02*** | (2006.01) |
| ***F04D 29/041*** | (2006.01) |
| ***F04D 7/04*** | (2006.01) |
| ***E21B 47/008*** | (2012.01) |
| ***F04D 15/00*** | (2006.01) |
| ***F04D 29/043*** | (2006.01) |
| ***E21B 43/24*** | (2006.01) |

(52) U.S. Cl.

CPC ..... *F04D 13/086* (2013.01); *E21B 43/128* (2013.01); *E21B 47/008* (2020.05); *F04D 7/04* (2013.01); *F04D 29/026* (2013.01); *F04D 29/0413* (2013.01); *F04D 29/0476* (2013.01); *E21B 43/2406* (2013.01); *F04D 15/0088* (2013.01); *F04D 29/043* (2013.01); *F05D 2300/10* (2013.01); *F05D 2300/224* (2013.01)

(58) Field of Classification Search

CPC ..... F04D 13/086; F04D 7/04; F04D 15/0088; F04D 29/026; F04D 29/0413; F04D 29/043; F04D 29/0476; F05D 2300/10; F05D 2300/224; E21B 47/0007; E21B 43/128; E21B 43/2406

See application file for complete search history.

(56) References Cited

U.S. PATENT DOCUMENTS

| | | | | |
|---|---|---|---|---|
| 7,703,982 | B2 * | 4/2010 | Cooley | F16C 17/02 175/320 |
| 8,678,657 | B1 * | 3/2014 | Knuteson | F16C 17/028 384/276 |
| 8,684,679 | B2 * | 4/2014 | Tetzlaff | F04D 13/08 415/170.1 |

(Continued)

FOREIGN PATENT DOCUMENTS

WO 2014201458 A1 12/2014

*Primary Examiner* — Brian P Wolcott

(57) ABSTRACT

An electric submersible pump system can include a shaft; at least one impeller operatively coupled to the shaft; and a bearing assembly that rotatably supports the shaft, where at least one component of the electric submersible pump includes a volumetric composite material that includes polycrystalline diamond material and at least one metallic material.

19 Claims, 15 Drawing Sheets

(56) References Cited

U.S. PATENT DOCUMENTS

| | | | | |
|---|---|---|---|---|
| 8,939,652 | B2 * | 1/2015 | Peterson | F16C 33/32 384/492 |
| 10,217,279 | B2 * | 2/2019 | Whalley | E21B 47/0002 |
| 2007/0081749 | A1 * | 4/2007 | Sexton | E21B 4/003 384/420 |
| 2009/0060408 | A1 * | 3/2009 | Nagasaka | C04B 41/009 384/625 |
| 2015/0147523 | A1 | 5/2015 | Kumar et al. | |
| 2015/0184671 | A1 | 7/2015 | Parmeter et al. | |
| 2017/0058616 | A1 * | 3/2017 | Lunk | E21B 43/128 |

* cited by examiner

System 1000

UNITARY THICK DIAMOND COMPOSITE DOWNHOLE TOOL COMPONENTS

BACKGROUND

An electric submersible pump (ESP) can include a stack of impeller and diffuser stages where the impellers are operatively coupled to a shaft driven by an electric motor or an electric submersible pump (ESP) can include a piston that is operatively coupled to a shaft driven by an electric motor, for example, where at least a portion of the shaft may include one or more magnets and form part of the electric motor. In such examples, fluid may include particles, which may impact various component and cause wear.

SUMMARY

An electric submersible pump system can include a shaft; at least one impeller operatively coupled to the shaft; and a bearing assembly that rotatably supports the shaft, where at least one component of the electric submersible pump includes a volumetric composite material that includes polycrystalline diamond material and at least one metallic material.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
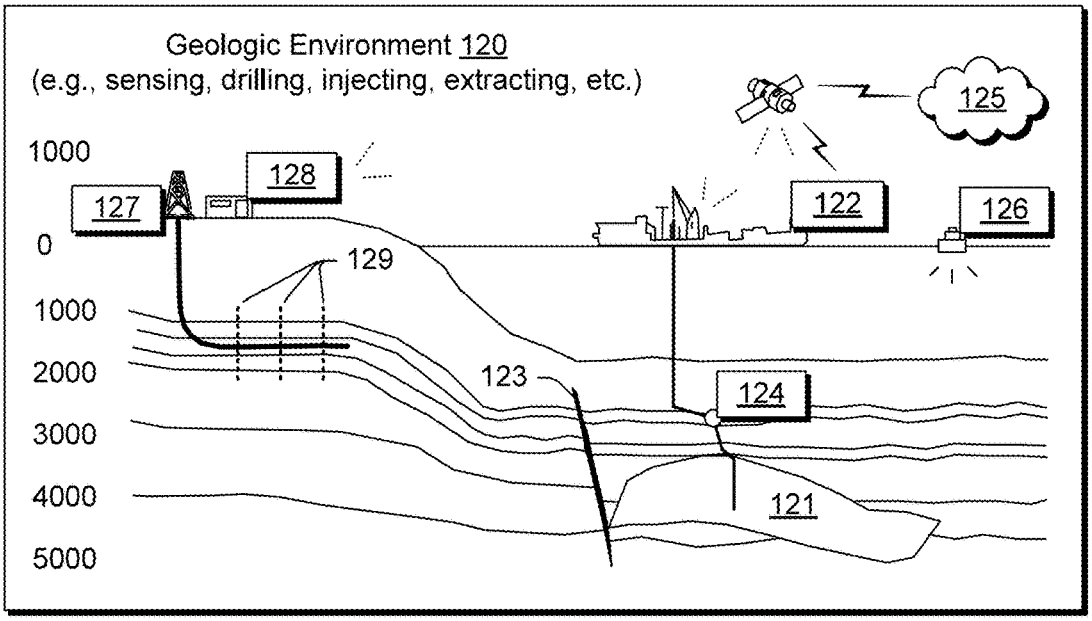
FIG. 1 illustrates examples of equipment in geologic environments.
Figure 1:
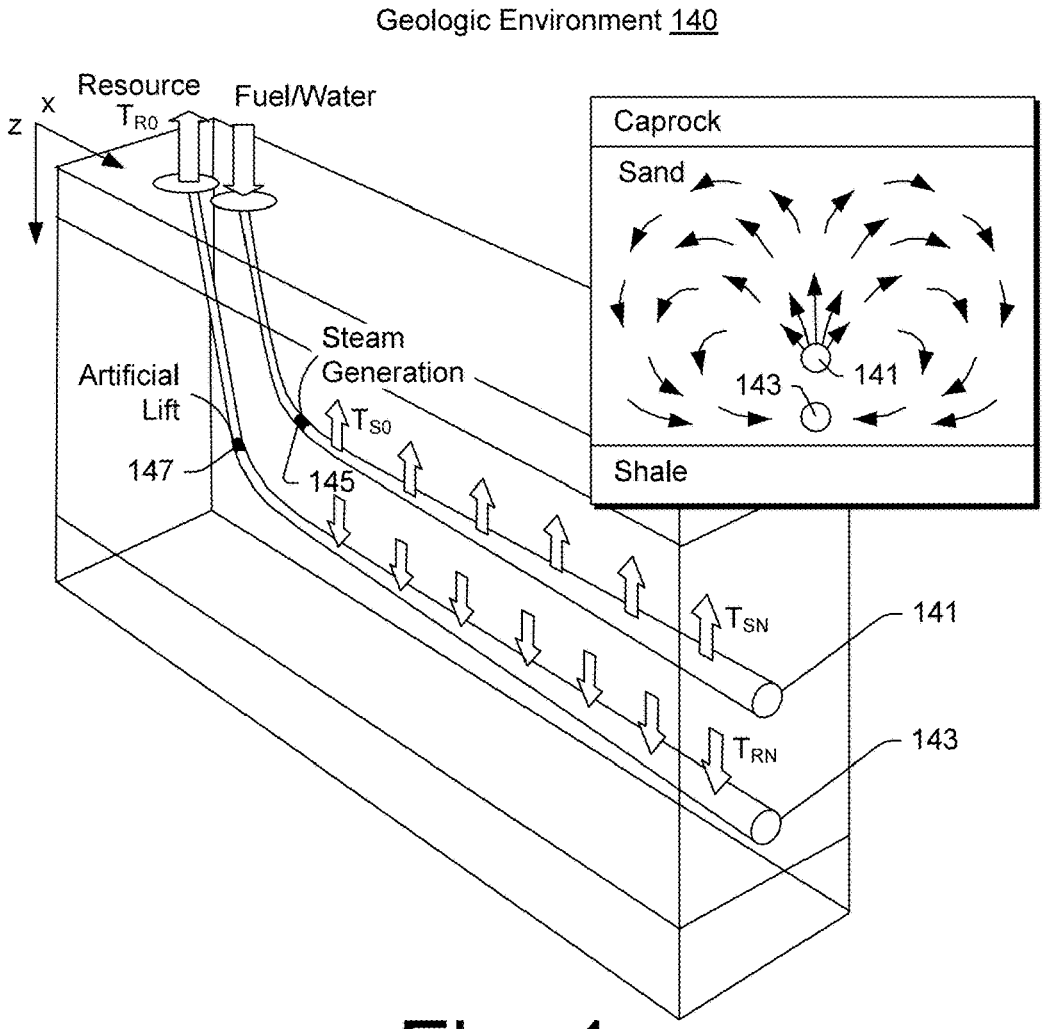

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP).

As illustrated in a cross-sectional view of FIG. 1, steam injected via the well 141 may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 (e.g., an ESP) may then assist with lifting the resource in the well 143 to, for example, a surface facility (e.g., via a wellhead, etc.). As an example, where a production well includes artificial lift equipment such as an ESP, operation of such equipment may be impacted by the presence of condensed steam (e.g., water in addition to a desired resource). In such an example, an ESP may experience conditions that may depend in part on operation of other equipment (e.g., steam injection, operation of another ESP, etc.).

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over an extended period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

Figure 2:
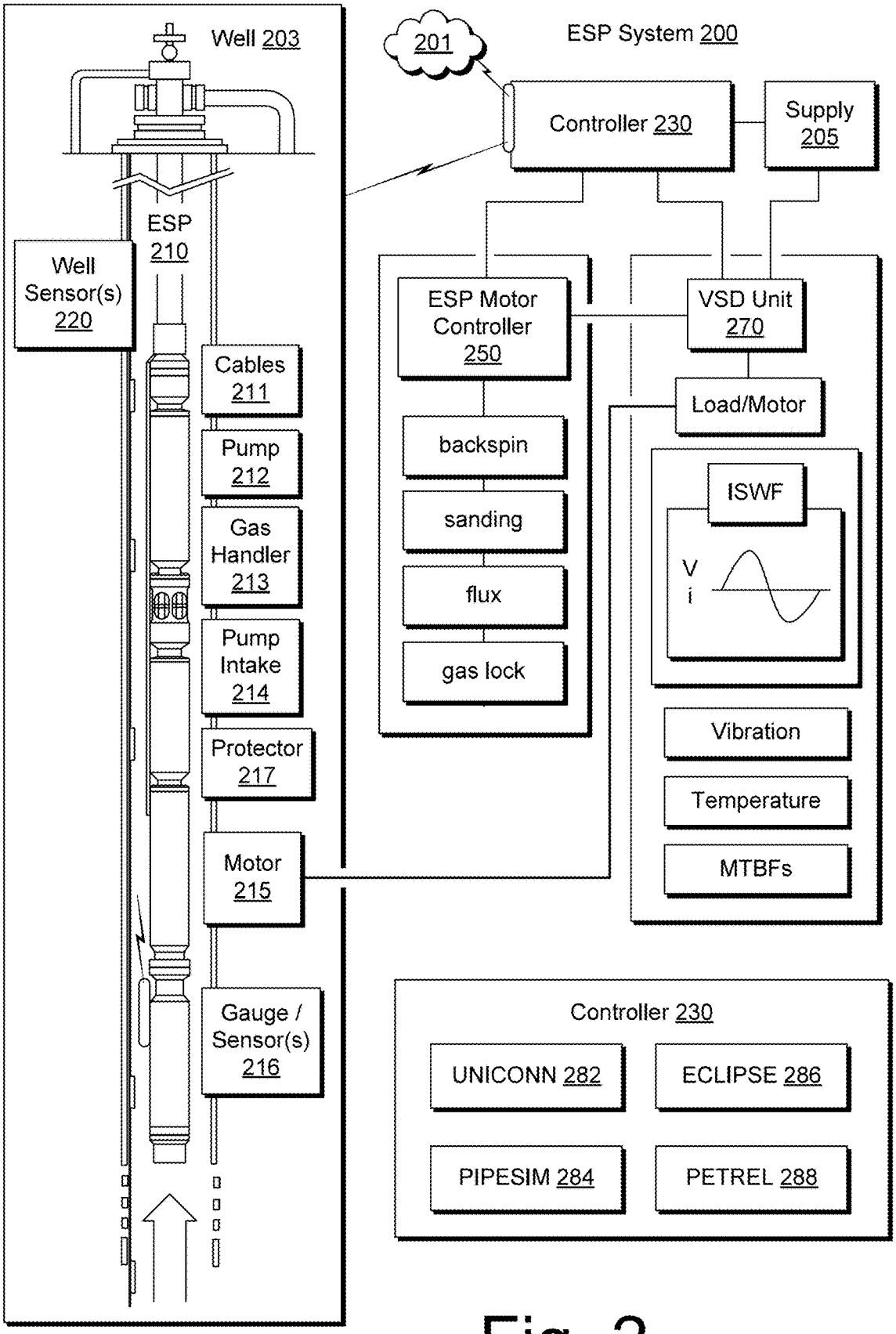
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, commercially available ESPs (such as the REDA™ ESPs marketed by Schlumberger Limited, Houston, Tex.) may find use in applications that call for, for example, pump rates in excess of about 4,000 barrels per day and lift of about 12,000 feet or more (e.g., about 4,000 meters or more).

As an example, the system 200 may include an electric submersible pump (ESP) that includes a piston that is operatively coupled to a shaft driven by an electric motor, for example, where at least a portion of the shaft may include one or more magnets and form part of the electric motor. Such a pump may be a reciprocal piston pump, which can include one or more valve mechanisms.

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source. The power supply 205 may supply a voltage, for example, of about 4.16 kV.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and optionally a protector 217.

As an example, an ESP may include a REDA™ HOTLINE™ high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

In the example of FIG. 2, the well 203 may include one or more well sensors 220, for example, such as the commercially available OPTICLINE™ sensors or WELLWATCHER BRITEBLUE™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 1,000 m or more) and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UNICONN™ motor controller 282 marketed by Schlumberger Limited (Houston, Tex.). In the example of FIG. 2, the controller 230 may access one or more of the PIPESIM™ framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UNICONN™ motor controller. The UNICONN™ motor controller can connect to a SCADA system, the ESPWATCHER™ surveillance system, etc. The UNICONN™ motor controller can perform some control and data acquisition tasks for ESPs, surface pumps or other monitored wells. The UNICONN™ motor controller can interface with the PHOENIX™ monitoring system, for example, to access pressure, temperature and vibration data and various protection parameters as well as to provide direct current power to downhole sensors (e.g., sensors of a gauge, etc.). The UNICONN™ motor controller can interface with fixed speed drive (FSD) controllers or a VSD unit, for example, such as the VSD unit 270.

For FSD controllers, the UNICONN™ motor controller can monitor ESP system three-phase currents, three-phase surface voltage, supply voltage and frequency, ESP spinning frequency and leg ground, power factor and motor load.

For VSD units, the UNICONN™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP, flux of an ESP and gas lock of an ESP. The motor controller 250 may include any of a variety of features, additionally, alternatively, etc.

In the example of sanding, one or more regions in an ESP may collect particulate matter that can be carried by fluid as it is pumped. Such particulate matter may settle in various regions of an ESP and build-up to a level where operation of the ESP becomes impacted. As an example, to handle particulate matter, a system may include a conditioner, which may condition particulate matter via mechanical action. As an example, a conditioner can be an assembly that includes one or more rotating or otherwise movable components that can mechanically impact particulate matter (e.g., size, shape, grind, recirculate, etc.). Where size is reduced, particulate matter may flow more readily rather than settle (e.g., according to a settling velocity, etc.).

In the example of FIG. 2, the VSD unit 270 may be a low voltage drive (LVD) unit, a medium voltage drive (MVD) unit or other type of unit (e.g., a high voltage drive (HVD), which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SPEEDSTAR™ MVD control circuitry marketed by Schlumberger Limited (Houston, Tex.).

Figure 3:
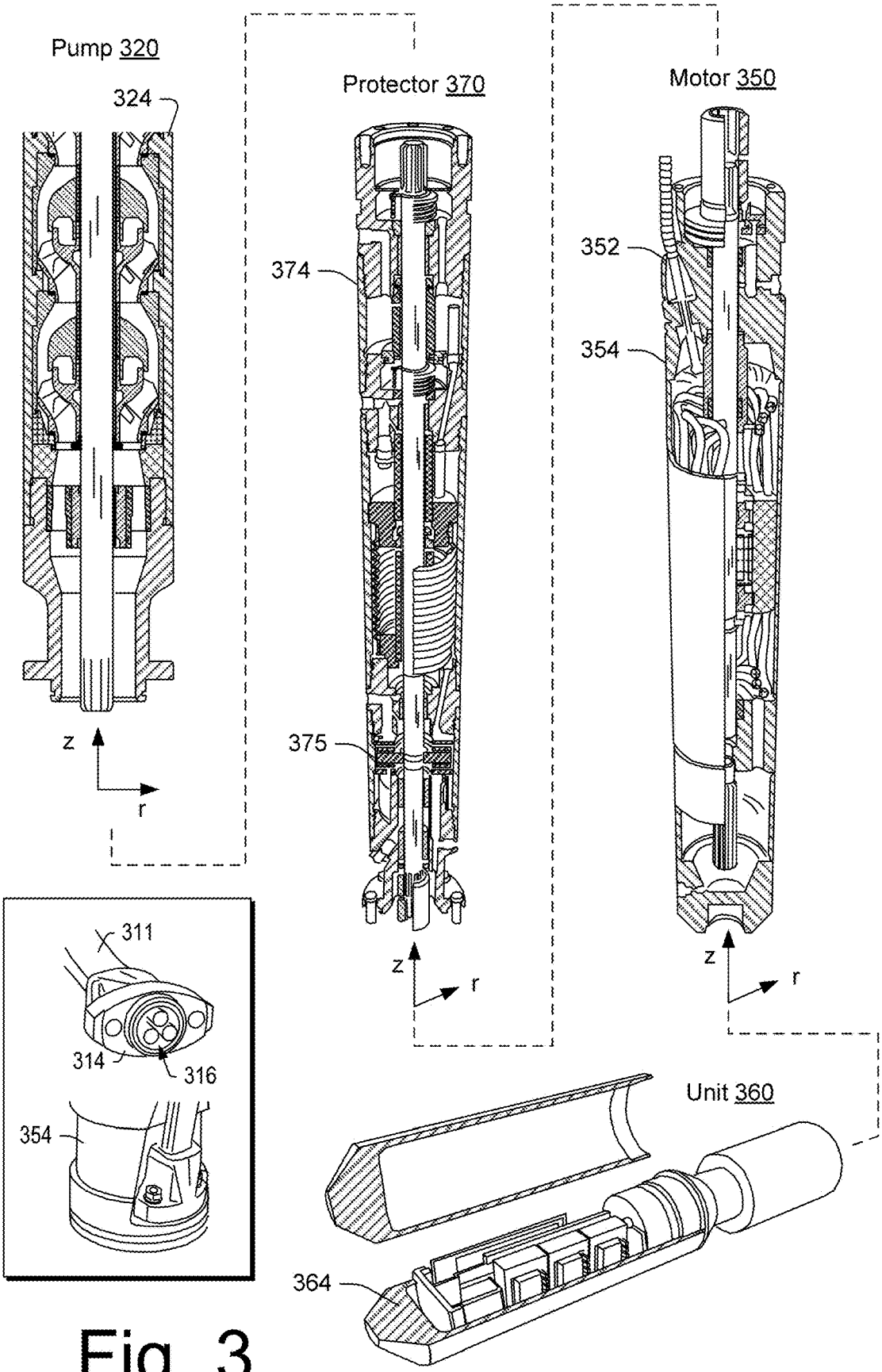
FIG. 3 illustrates examples of equipment.

FIG. 3 shows cut-away views of examples of equipment such as, for example, a portion of a pump 320, a protector 370, a motor 350 of an ESP and a sensor unit 360. The pump 320, the protector 370, the motor 350 and the sensor unit 360 are shown with respect to cylindrical coordinate systems (e.g., r, z, Θ). Various features of equipment may be described, defined, etc. with respect to a cylindrical coordinate system. As an example, a lower end of the pump 320 may be coupled to an upper end of the protector 370, a lower end of the protector 370 may be coupled to an upper end of the motor 350 and a lower end of the motor 350 may be coupled to an upper end of the sensor unit 360 (e.g., via a bridge or other suitable coupling).

As shown in FIG. 3, the pump 320 can include a housing 324, the motor 350 can include a housing 354, the sensor unit 360 can include a housing 364 and the protector 370 can include a housing 374 where such housings may define interior spaces for equipment. As an example, a housing may have a maximum diameter of up to about 30 cm and a shaft may have a minimum diameter of about 2 cm. As an example, a sensor can include a sensor aperture that is disposed within an interior space of a housing where, for example, an aperture may be in a range of about 1 mm to about 20 mm. In some examples, the size of an aperture may be taken into account, particularly with respect to the size of a shaft (e.g., diameter or circumference of a shaft). As an example, given dynamics that may be experienced during operation of equipment (e.g., a pump, a motor, a protector, etc.), error compensation may be performed that accounts for curvature of a shaft or, for example, curvature of a rotating component connected to the shaft.

As an example, an annular space can exist between a housing and a bore, which may be an open bore (e.g., earthen bore, cemented bore, etc.) or a completed bore (e.g., a cased bore). In such an example, where a sensor is disposed in an interior space of a housing, the sensor may not add to the overall transverse cross-sectional area of the housing. In such an example, risk of damage to a sensor may be reduced while tripping in, moving, tripping out, etc., equipment in a bore.

As an example, a protector can include a housing with an outer diameter up to about 30 cm. As an example, consider a REDA MAXIMUS™ protector (Schlumberger Limited, Houston, Tex.), which may be a series 387 with a 3.87 inch housing outer diameter (e.g., about 10 cm) or a series 562 with a 5.62 inch housing outer diameter (e.g., about 14 cm) or another series of protector. As an example, a REDA MAXIMUS™ series 540 protector can include a housing outer diameter of about 13 cm and a shaft diameter of about 3 cm and a REDA MAXIMUS™ series 400 protector can include a housing outer diameter of about 10 cm and a shaft diameter of about 2 cm. In such examples, a shaft to inner housing clearance may be an annulus with a radial dimension of about 5 cm and about 4 cm, respectively. Where a sensor and/or circuitry operatively coupled to a sensor are to be disposed in an interior space of a housing, space may be limited radially; noting that axial space can depend on one or more factors (e.g., components within a housing, etc.). For example, a protector can include one or more dielectric oil chambers and, for example, one or more bellows, bags, labyrinths, etc. In the example of FIG. 3, the protector 370 is shown as including a thrust bearing 375 (e.g., including a thrust runner, thrust pads, etc.).

As to a motor, consider, for example, a REDA MAXIMUS™ PRO MOTOR™ electric motor (Schlumberger Limited, Houston, Tex.), which may be a 387/456 series with a housing outer diameter of about 12 cm or a 540/562 series with a housing outer diameter of about 14 cm. As an example, consider a carbon steel housing, a high-nickel alloy housing, etc. As an example, consider an operating frequency of about 30 to about 90 Hz. As an example, consider a maximum windings operating temperature of about 200 degrees C. As an example, consider head and base radial bearings that are self-lubricating and polymer lined. As an example, consider a pot head that includes a cable connector for electrically connecting a power cable to a motor.

As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle (e.g., as may be defined with respect to gravity, etc.). Orientation of an ESP with respect to gravity may be considered as a factor, for example, to determine ESP features, operation, etc.

As shown in FIG. 3, the motor 350 is an electric motor that includes a cable connector 352, for example, to operatively couple the electric motor to a multiphase power cable, for example, optionally via one or more motor lead extensions. Power supplied to the motor 350 via the cable connector 352 may be further supplied to the sensor unit 360, for example, via a wye point of the motor 350 (e.g., a wye point of a multiphase motor).

As an example, a connector may include features to connect one or more transmission lines dedicated to a monitoring system. For example, the cable connector 352 may optionally include a socket, a pin, etc., that can couple to a transmission line dedicated to the sensor unit 360. As an example, the sensor unit 360 can include a connector that can connect the sensor unit 360 to a dedicated transmission line or lines, for example, directly and/or indirectly.

As an example, the motor 350 may include a transmission line jumper that extends from the cable connector 352 to a connector that can couple to the sensor unit 360. Such a transmission line jumper may be, for example, one or more conductors, twisted conductors, an optical fiber, optical fibers, a waveguide, waveguides, etc. As an example, the motor 350 may include a high-temperature optical material that can transmit information. In such an example, the optical material may couple to one or more optical transmission lines and/or to one or more electrical-to-optical and/or optical-to-electrical signal converters.

FIG. 3 shows an example of a cable 311 that includes a connector 314 and conductors 316, which may be utilized to deliver multiphase power to an electric motor and/or to communicate signals and/or to delivery DC power (e.g., to power circuitry operatively coupled to a wye point of an electric motor, one or more sensors, etc.). As an example, the cable connector 352 may be part of a pot head portion of a housing 354. As an example, the cable 311 may be flat or round. As an example, a system may utilized one or more motor lead extensions (MLEs) that connect to one or more cable connectors of an electric motor. As an example, the sensor unit 360 can include transmission circuitry that can transmit information via a wye point of the motor 350 and via the cable connection 352 to the cable 311 where such information may be received at a surface unit, etc. (e.g., consider a choke, etc. that can extract information from one or more multiphase power conductors, etc.).

As an example, one or more components, assemblies, systems, etc. can include one or more pieces of a volumetric composite material that includes diamond material and at least one metallic material, which may be a substantially pure metal, a metal alloy or a metallic composite material that is predominantly (e.g., greater than 50 percent) a metal or metals. Such a volumetric composite material can be a thick diamond composite (TDC) that includes polycrystalline diamond (PCD).

Diamond can be one single, continuous crystal or it can be made up of many smaller crystals (polycrystal). Polycrystalline diamond (PCD) includes numerous relatively small grains that can exhibit light absorption and scattering. PCD may be characterized by one or more physical properties, which can include dimensions. For example, PCD material may be characterized by a grain size or grain sizes of crystals (e.g., average grain size, median grain size, modality of grain size distribution, etc.). For PCD material, grain sizes can range from the order of nanometers to the order of hundreds of micrometers (microns). As an example, a PCD material may be referred to as being "nanocrystalline" or "microcrystalline", with respect to diamond content (diamond crystals).

As an example, a metal may be selected from alkali metals, alkaline earth metals, transition metals, lanthanides and actinides. As an example, a metallic material can include at least one metal and at least another material, which may be a metal or a non-metal. As an example, a metallic material can include a metal alloy. As an example, a metallic material may be selected to provide particular characteristics to a TDC material. Such characteristics may be appropriate for use of the TDC material as a volumetric composite material, which can be a component that is part of an assembly or that can be utilized as a part of an assembly. A component may have particular characteristics that may or may not change over time. As an example, an electrical submersible pump system can include one or more pieces of a TDC material. A volumetric composite material can be a piece of TDC material.

An ESP system can include a variety of radial and thrust surfaces which in abrasive environments (e.g. fluids containing wellbore sand) tend to wear. For example, a bearing surface can wear in a manner that can cause subsequent undesirable vibration, leakage, and possibly failure.

As an example, a bearing can include a thick diamond composite piece. Such a bearing can be referred to as a TDC bearing. As an example, a TDC bearing may be used in an electric submersible pump system.

A TDC piece is monolithic and of dimensions and that define it as being a piece of a volumetric composite material that is free-standing; unlike a surface coating that depends on another component onto which the surface coating can be formed.

As an example, a TDC material can be formed by a high-pressure, high-temperature (HPHT) sintering process that includes sintering a mixture of diamond and one or more metallic powders.

As an example, a TDC bearing can exhibit desirable resistance to wear (e.g., abrasion and erosion), a low coefficient of friction, and high thermal conductivity.

TDC pieces may be utilized in one or more of the following applications: thrust bearings (e.g., unitized or one or more pads) in pumps and protectors; radial bearings (e.g., unitized or one or more pads) in pumps; radial or "ARZ" bearings, optionally sequenced such that each n-th ARZ bearing includes TDC material; shaft seals (e.g., face seals) in protectors; a "sand grinder" that operates to reduce the size or otherwise condition sand (e.g., at one or more locations associated with pumping equipment); fluid throttling surfaces and flow diffusing surfaces in a hydraulic balance assembly (e.g., where surfaces may otherwise tend to rapidly wear with hardened metals or ceramics (e.g., tungsten carbide, etc.) and make the assembly ineffective).

As to an ESP system, applications for TDC pieces include sensor flow protectors such as, for example, non-metallic flow isolators from sensors (e.g. the window that would separate a proximity sensor from well fluid) and flow conditioner/protectors (e.g., downstream and/or upstream flow-pattern modifiers that can change well fluid velocity/angle impacting a sensor or other "delicate" features of a sensor).

As to an ESP system, applications for TDC pieces include abrasion resistant pump stages (e.g., a TDC impeller and a TDC diffuser) such as, for example, a complete stage made of TDC material, TDC material inserts in one or more particular impeller regions and/or in one or more particular diffuser regions.

Applications for TDC pieces can include pieces for an abrasion resistant pump, gas handler, sensor unit (e.g., sensor assembly), intake internals, etc. For example, one or more elements prone to erosion (e.g., spacers, flange necks, etc.) may be constructed from TDC material optionally as unitary pieces. As an example, one or more elements prone to recirculation of fluid, which may include particles, may be constructed from TDC material.

As an example, one or more downhole heat sinks (e.g., for sensors, electronics, or other hotspots) may be constructed from TDC material. As an example, a TDC material may be characterized at least in part by thermal conductivity. For example, a TDC material can have a thermal conductivity that is within a range from approximately 150 W/mK to approximately 250 W/mK. As an example, a TDC material can have a thermal conductivity that is above that of non-precious metals and aluminum. A TDC material may be a unitary piece that includes dimensions that provide for conduction of thermal energy from one region to another region. A TDC material thermal conductor may be rated to perform for a desired period of time when in prolonged contact with fluid such as well fluid, which may include sour gas.

As an example, a TDC radial bearing can have a relatively small radial clearance (e.g., less than approximately 0.001 inch or approximately 0.0254 mm) between two surfaces. In such an example, the clearance may be sufficiently small to filter various sizes of particles, which may be abrasive particles. A clearance may be relatively small due to one or more properties of TDC material, which may include one or more thermal properties and, for example, one or more friction properties (e.g., coefficient of friction).

Figure 4:
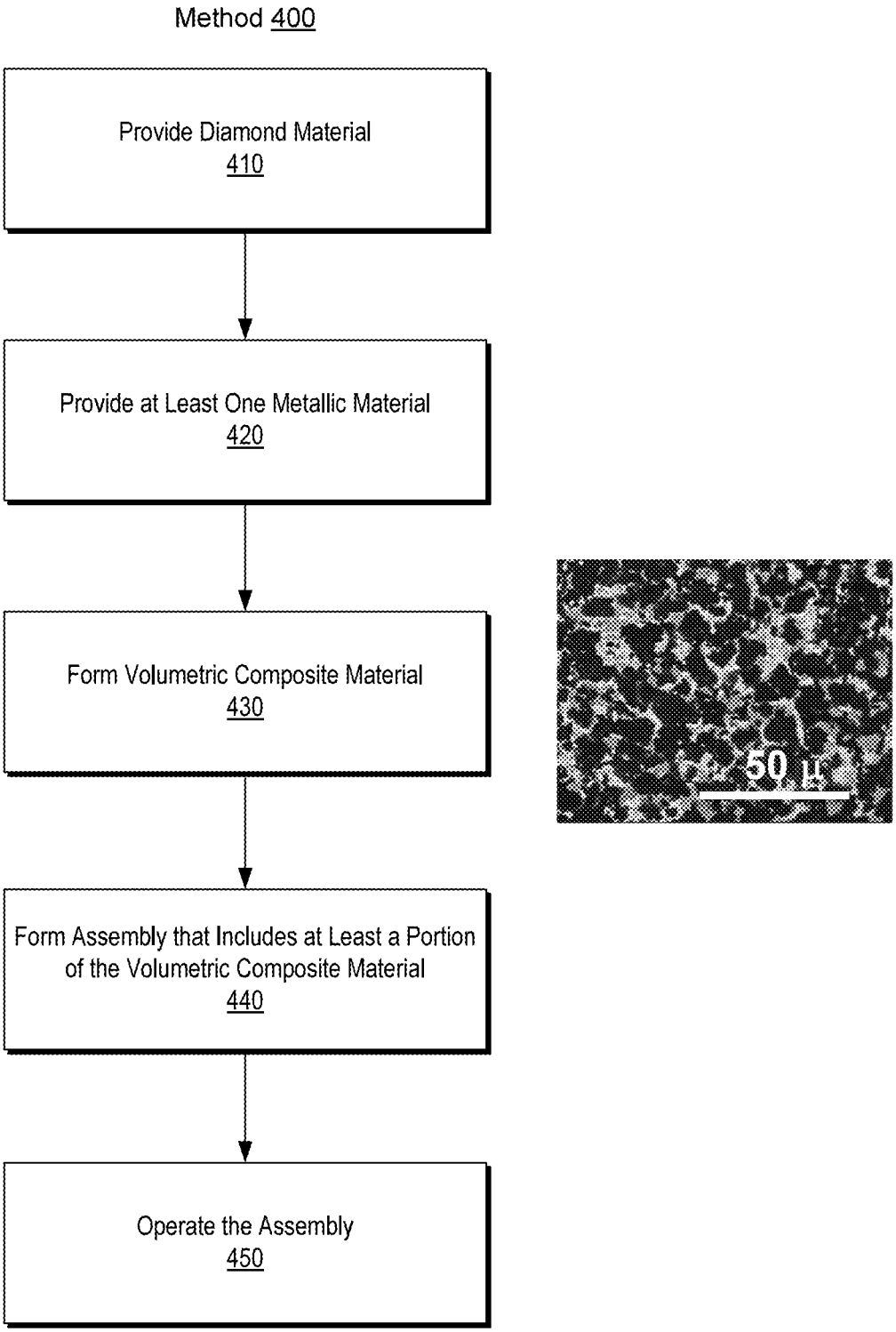
FIG. 4 illustrates an example of a method and an example of a micrograph of a volumetric composite material.

FIG. 4 shows an example of a method 400 that includes a provision block 410 for providing diamond material, a provision block 420 for providing at least one metallic material, a formation block 430 for forming a volumetric composite material, a formation block 440 for forming an assembly that includes at least a portion of the volumetric composite material, and an operation block 450 for operating the assembly. FIG. 4 shows an example of a micrograph of a volumetric composite material that includes polycrystalline diamond material and at least one metallic material. As shown, various crystals in the volumetric composite material have maximum dimensions (size dimension) that are less than approximately 50 microns. As shown, various crystals have maximum dimensions that may be in a range of approximately 5 microns to approximately 20 microns.

In various embodiments, a component may be formed from a polycrystalline diamond (PCD) material having approximately 70 percent to approximately 95 percent diamond volume content where, for example, a PCD volume is greater than approximately 0.15 cubic inches (e.g., approximately 2.4 $cm^3$) and an aspect ratio greater than approximately 1/15. In such an example, the PCD volume can be a TDC volume. In such an example, the PCD material can include one or more metallic materials.

As an example, a PCD material, which may be a TCD material, can be an electrical insulator and a thermal conductor. As an example, a TCD material can include surface variations. As an example, a TCD material can include surface porosity. As an example, a TCD material may be a soaked in a material, which may be a fluid such as a lubricant fluid. As an example, consider soaking or otherwise treating a TCD material with a lubricant fluid such as an oil that is a polymeric oil and/or that includes one or more polymers. An oil may be a perfluoropolyether (PFPE) oil and/or an oil that includes polytetrafluoroethylene material (PFPE oil with PTFE particles, etc.) (e.g., TEFLON™ material, etc.) and/or a mineral oil with PTFE material.

As an example, a TDC material, as a volumetric composite material, can include surface porosity and/or surface roughness that can be impregnated with another material. For example, lubricating material such as PTFE material may be impregnated into the surface porosity and be referred to as impregnated lubricant (impregnated PTFE material). As an example, a TDC material may be impregnated with another material (e.g., lubricant) via a vacuum/pressure impregnation process. As an example, such an impregnated material may respond to friction (e.g., heat generation, etc.), which may cause the material melt and/or flow from the surface pores and/or surface roughness (e.g., surface roughness, etc.). As an example, a TDC material can be a volumetric composite material that includes surface features that are impregnated with lubricant. In such an example, the lubricant can be disposed in surface pores and/or surface roughness of the TDC volumetric composite material. As an example, surface pores may be formed in part via leaching. As an example, a TDC component may be manufactured with a desired surface roughness. As an example, surface roughness can be from rough to smooth, which may have an associated cost and, for example, associated wear and/or friction characteristics. As an example, a manufacturing process may consider cost and friction with respect to surface features and/or impregnation of such surface features. For example, it may cost more to produce a smoother surface and it may cost less to impregnate a rougher surface. In both instances, desirable characteristics may be achieved with respect to an application or applications for a TDC component. In such an example, the nature of the application or applications may be taken into account in making a TDC component with particular surface characteristics and/or surface behavior, which may consider time, etc.

Figure 5:
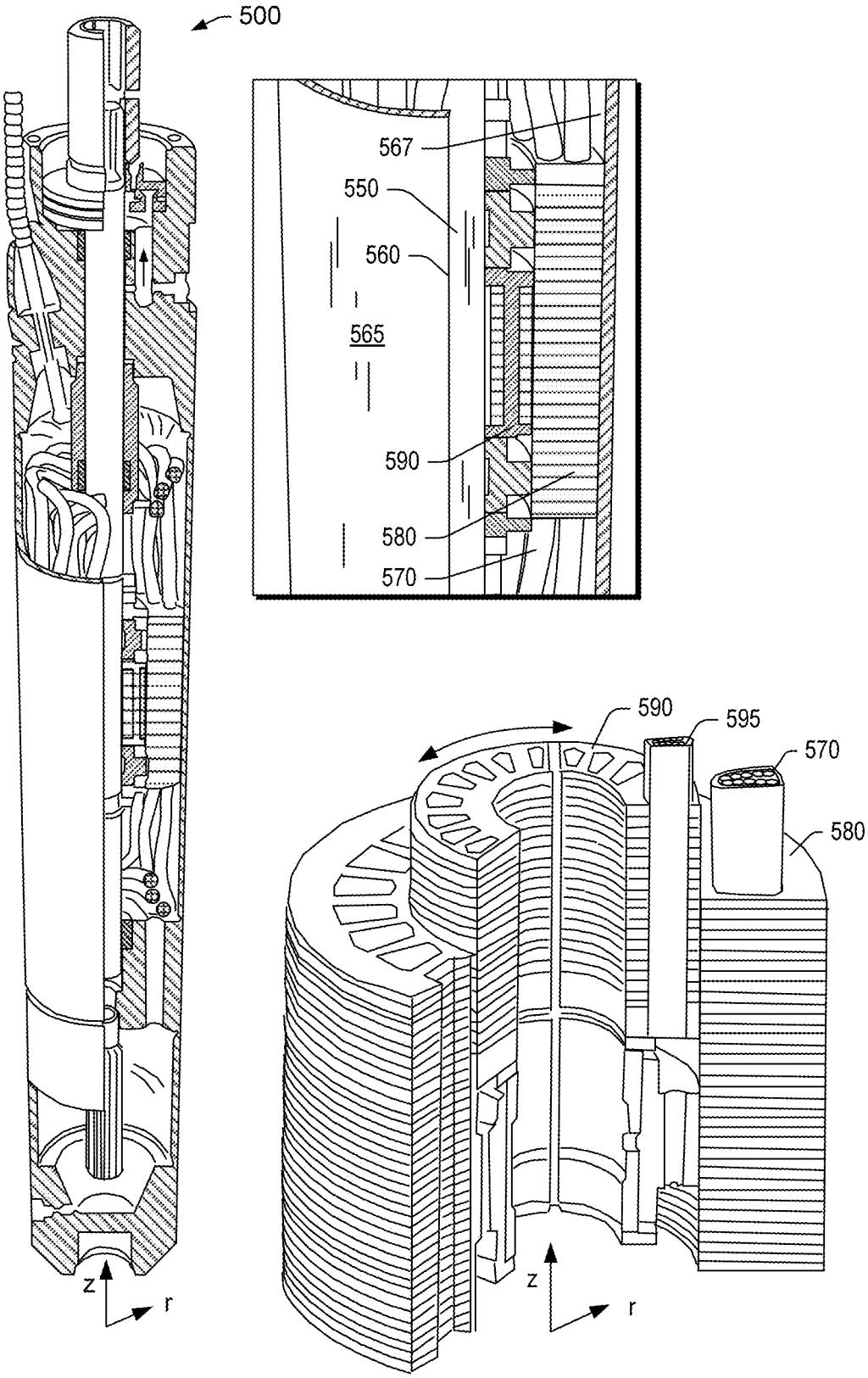
FIG. 5 illustrates an example of a submersible electric motor.

FIG. 5 shows an example of an electric motor assembly 500 that includes a shaft 550, a housing 560 with an outer surface 565 and an inner surface 567, stator windings 570, stator laminations 580, rotor laminations 590 and rotor windings 595. As shown, the rotor laminations 590 are operatively coupled to the shaft 550 such that rotation of the rotor laminations 590, with the rotor windings 595 therein, can rotate the shaft 550. As mentioned, a shaft may be reciprocating, for example, where a shaft includes one or more magnets (e.g., permanent magnets) that respond to current that passes through stator windings. As an example, the housing 560 may define a cavity via its inner surface 567 where the cavity may be hermetically sealed. As an example, such a cavity may be filled at least partially with dielectric oil. As an example, dielectric oil may be formulated to have a desired viscosity and/or viscoelastic properties, etc.

As an example, a sensor may be integrated into one or more of the stator windings 570 and/or into one or more of the stator laminations 580. As an example, a sensor may be integrated into one or more of the rotor windings 595 and/or into one or more of the rotor laminations 590.

As an example, one or more sensors may be disposed within a space defined by the housing 560 of the electric motor assembly 500. As an example, a sensor may be an accelerometer (e.g., a single or multi-axis accelerometer) that can sense movement. As an example, the housing 560 of the electric motor assembly 500 may be at least partially filled with a fluid (e.g., dielectric fluid, etc.) where a sensor may sense pressure waves that pass through the fluid. In such an example, pressure waves may be sensed that are due to vibration, which may be undesirable vibration. As an example, circuitry may filter pressure waves associated with rotational operation of an electric motor from pressure waves associated with vibration of one or more components of the electric motor (e.g., a housing, a shaft, etc.). As an example, a sensor may include one or more piezo-elements that respond to stress and/or strain. As an example, a sensor may detect movement of one component with respect to another component.

A sensor may include circuitry for speed and/or vibration sensing. A sensor may include circuitry for axial displacement sensing. As an example, sensors may include one or more of an impeller vane sensor configured for vane pass speed and/or vane wear sensing, a hydraulic seal sensor configured for leakage and/or wear sensing, a diffuser sensor configured for separation sensing, a bellows sensor configured for expansion and/or contraction sensing, a shaft seal sensor configured for separation, wear and/or skipping sensing and/or a thrust bearing sensor configured for lift sensing. As an example, one or more sensors may be part of equipment such as equipment that can be deployed in a downhole environment. As an example, one or more sensors may be a proximity sensor.

Figure 6:
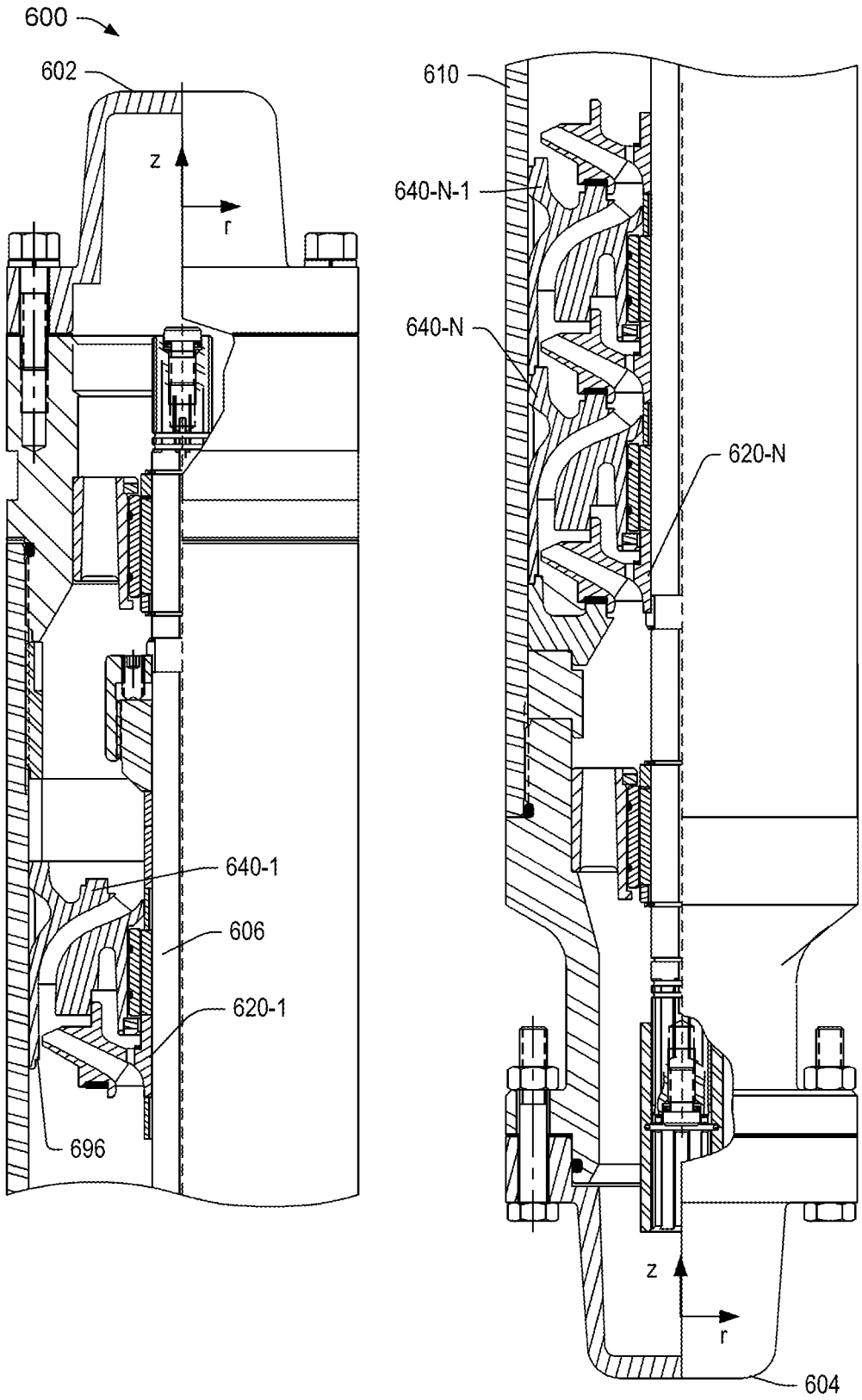
FIG. 6 illustrates an example of a pump.

FIG. 6 shows cutaway views of a system 600. As shown the system 600 includes an end cap 602 and an end cap 604 that are fit to ends of a housing 610 that houses various components of a pump such as a shaft 606, impellers 620-1 to 620-N and diffusers 640-1 to 640-N. The end caps 602 and 604 may be employed to protect the system 600, for example, during storage, transport, etc.

In the example of FIG. 6, rotation of the shaft 606 (e.g., about a z-axis) can rotate the impellers 620-1 to 620-N to move fluid upwardly where such fluid is guided by the diffusers 640-1 to 640-N. As an example, a pump stage may be defined as an impeller and a diffuser, for example, the impeller 620-1 and the diffuser 640-1 may form a pump stage. In the example of FIG. 6, flow in each stage may be characterized as being mixed in that flow is both radially and axially directed by each of the impellers 620-1 to 620-N and each of the diffusers 640-1 to 640-N (see, e.g., the r, z coordinate system).

As an example, a sensor may be mounted in an opening of the housing 610 and include an end directed toward the shaft 606. A sensor may include circuitry such as, for example, emitter/detector circuitry, power circuitry and communication circuitry. As an example, power circuitry may include power reception circuitry, a battery or batteries, power generation circuitry (e.g., via shaft movement, fluid movement, etc.), etc. As an example, communication circuitry may include an antenna or antennas, wires, etc. As an example, communication circuitry may be configured to communication information (e.g., receive and/or transmit) via wire (e.g., conductor or conductors) or wirelessly.

As to control, where shaft vibration is detected at a particular rotational speed of the shaft 606, power to a motor operatively coupled to the shaft 606 may be adjusted to alter the rotational speed, for example, in an effort to reduce the shaft vibration. In such an example, a sensor may be part of a feedback control loop. In such an example, vibration reduction may improve pump performance, pump longevity, etc.

As an example, one or more mechanisms may act to reduce or damp vibrations of a shaft during operation, as driven by an electric motor. Such one or more mechanisms may operate independent of sensed information (e.g., vibration measurement) and/or may operate based at least in part on sensed information (e.g., vibration measurement and optionally other information, etc.).

As an example, where a shaft is supported by one or more bearings, walking, shifting, etc. of the shaft with respect to the one or more bearings may be related to rotational speed, load, etc. For example, a shaft may "walk up" (e.g., ride up, ride down, etc.) with respect to a bearing in a manner dependent on shaft rotational speed. As an example, a shaft may seat in a bearing in a manner that depends on one or more operational conditions (e.g., shaft rotational speed, fluid properties, load, etc.). In such an example, a shaft may change in its radial position, axial position or radial and axial position with respect to a bearing. As an example, a shaft displacement sensor may be configured to sense one or more of axial and radial position of a shaft. In such an example, where a change in shaft speed occurs, a change in axial and/or radial position of the shaft (e.g., optionally with respect to a bearing, etc.) may be used to determine axial and/or radial displacement of the shaft.

As to control, where shaft axial movement is detected at a particular rotational speed of the shaft 606, power to a motor operatively coupled to the shaft 606 may be adjusted to alter the rotational speed, for example, in an effort to reduce the axial shaft movement. In such an example, a sensor may be part of a feedback control loop. In such an example, reduction of axial movement of the shaft 606 may improve pump performance, pump longevity, etc.

As an example, a proximity sensor may be configured to detect presence of an object without direct contact with the object (e.g., a non-contact sensor). In such an example, an object may be a component, a marker or other object. As an example, a proximity sensor may detect a clearance (e.g., a gap) between objects or, for example, adjacent to an object. As an example, a sensor may employ a contact mechanism to determine proximity or, for example, lack thereof, with respect to an object. For example, consider a strain gauge that can measure strain with respect to two components where the strain depends on proximity of one of the components with respect to the other one of the components.

Figure 7:
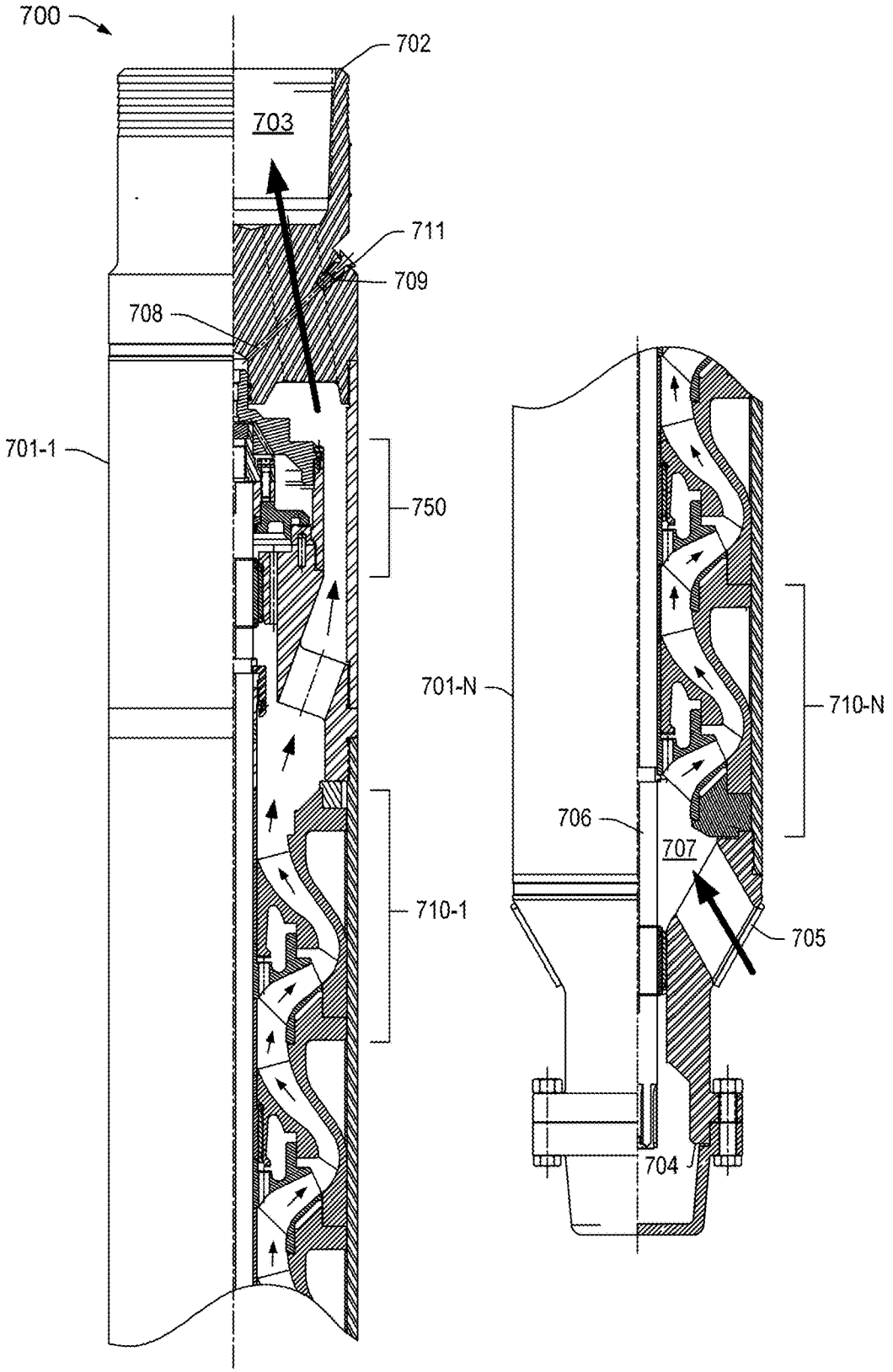
FIG. 7 illustrates an example of a system that includes an example of a hydraulic balance assembly.

FIG. 7 shows an example of a system 700 that includes a hydraulic balance assembly 750 that can help to reduce compression pump downthrust. The system 700 includes a series of housings 701-1 to 701-N between opposing ends 702 and 704 where fluid can be pumped in a direction from the end 704 toward the end 702. For example, fluid can enter via one or more openings 705 (e.g., inlets) to a space 707 where a motor driven shaft 706 can rotate to cause impellers of stages 710-1 to 710-N to rotate and direct fluid through corresponding diffusers of the stages 710-1 to 710-N. Fluid can exit the system 700 via an outlet 703 at the end 702.

In the example of FIG. 7, various arrows are shown that indicate a general direction of fluid flow. Fluid may include particulate material that may be abrasive and cause wear of various components of the system 700. For example, wear may occur with respect to moving component and/or stationary components, which may be impacted by flow or be adjacent to a moving component or components. As an example, impellers, diffusers, the shaft, the housings, etc. may be subject to wear. During operation, the system 700 may experience various forces, which may include static forces and dynamic forces. For example, components may accelerate, decelerate, vibrate, contact, grind particles, collect particles, etc.

Figure 8:
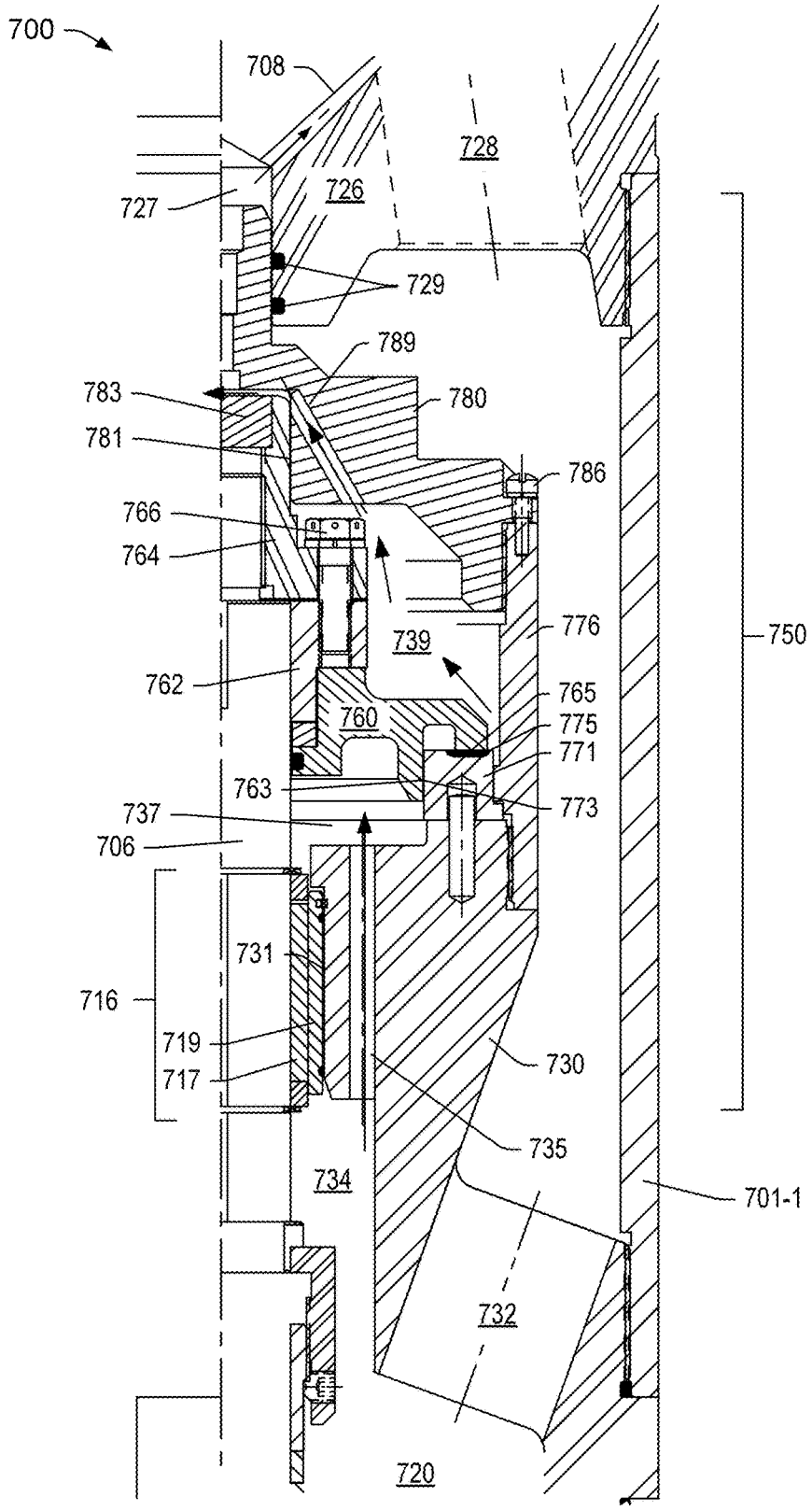
FIG. 8 illustrates a portion of the system of FIG. 7.

FIG. 8 shows a cross-sectional view of a portion of the system 700, particularly the hydraulic balance assembly 750 and some neighboring components. The hydraulic balance assembly 750 is shown as being within a space defined by the housing 701-1. The shaft 706 is rotatably supported by a bearing assembly 716 that includes a rotating smaller diameter component 717 (e.g., a sleeve) fixed to the shaft 706 and a larger diameter component 719 (e.g., a bearing) that can be stationary and seated in a recess 731 of a flow divider 730, which divides fluid flow from an annular region 720 via one or more passages 732 of the flow divider 730 to a first annular region, defined in part by an inner surface of the housing 701-1 and in part by an outer surface of the flow divider 730, and via a central bore 734 of the flow divider 730 to a second, smaller annular region that is defined in part by a bore surface of the central bore 734 and an outer surface of the shaft 706.

Fluid flowing to the first annular region can continue upwardly to the outlet 703 at the end 702; whereas, fluid flowing to the second, smaller annular region can be further directed via one or more passages 735 to a chamber 737 that is defined at least in part axially between the flow divider 730 and a rotating cap 760 that can move up and down axially, at least in part due to pressure in the chamber 737.

As to the bearing assembly 716, depending on one or more factors such as one or more of pressure, fluid flow, speed of the shaft, clearance, etc., some amount of fluid may flow in an annular clearance between the smaller diameter component 717 and the larger diameter component 719. In such an example, particles may flow in the annular clearance and cause wear as the shaft 706 rotates, which rotates the smaller diameter component 717.

As an example, one or more of the bearing components 717 and 719 can be a TDC material, which may be a unitary piece. In such an example, characteristics such as low friction, hardness, thermal conductivity, etc. may enhance longevity, performance, etc. of the bearing assembly 716.

As mentioned, fluid can flow via the one or more passages 735, which are generally axially directed, to the chamber 737. The chamber 737 is defined by various components, including the shaft 706, the flow divider 730, the rotating cap 760 and an annular component 771. As shown, the rotating cap 760 includes a radially outwardly facing surface 763 and an axially downwardly facing surface 765 and the annular component 771 includes a radially inwardly facing surface 773 and an axially upwardly facing surface 775.

During rotation of the shaft 706, the rotating cap 760 can rotate where an annular clearance exists between the surfaces 763 and 773. Where the rotating cap 760 moves upwardly, an axial clearance exists between the surfaces 765 and 775 and, where the rotating cap 760 moves downwardly, the axial clearance can diminish and the surfaces 765 and 775 can contact while the rotating cap 760 is rotating with respect to the annular component 771 being stationary as it may be bolted or otherwise fixed to the flow divider 730.

As to the hydraulic balance assembly 750, it includes the rotating cap 760 and various other components such as an annular clamp 762 that can be bolted via one or more bolts 766 to a shaft end piece 764. As shown, the shaft end piece 764 can be seated in a stepped bore 781 of a cover 780 that is bolted via one or more bolts 786 to an end of a hydraulic balance assembly housing 776 where the hydraulic balance assembly housing 776 is coupled to the flow divider 730 at an opposing end (e.g., via threads, etc.).

As shown, the hydraulic balance assembly housing 776 is at a first diameter and the housing 701-1 is at a second, larger diameter such that an annular flow space is defined by an outer surface of the hydraulic balance assembly housing 776 and an inner surface of the housing 701-1. In the system 700, the flow divider 730 directs a portion of pumped fluid to a primary flow path via the annular flow space and directs a portion of pumped fluid to a secondary, adjustable flow path via the hydraulic balance assembly 750.

As fluid flows to the chamber 737, a pressure differential may cause the rotating cap 760 to move axially upwardly away from the chamber 737 and toward a chamber 739. As the rotating cap 760 moves axially upwardly, a gap can open between the contact surface 775 of the annular component 771 and the surface 765 of the rotating cap 760. In such an example, fluid can flow between the surfaces 763 and 773 and between the surfaces 765 and 775. Such flow may be in part due to a pressure differential between the chambers 737 and 739. For example, where the pressure is less in the chamber 739 than in the chamber 737, the rotating cap 760 may move axially upwardly such that fluid flows from the chamber 737 to the chamber 739. Fluid in the chamber 739 can flow via one or more passages 789 in the cover 780 and through an axial clearance between the shaft end piece 764 and the stepped bore 781 of the cover 780.

When pressure differential on the rotating cap 760 lifts it to the limit of desired travel, the end piece 764 can snub off flow through holes 789, which can create a back pressure that reduces the pressure differential on the rotating cap 760. The rotating cap 760 can move axially down. Such a process can depend on the upper end of end piece 764 bearing against the downward facing portion of the cover 780, which can cause wear, for example, of an insert 783, which may be of hardened metal or ceramic. As an example, the insert 783 may be a TDC component.

As shown in the example of FIG. 8, an outlet component 726 may be coupled to the housing 701-1 where the outlet component 726 includes a central recess 727 that can receive a portion of the cover 780 as well as one or more outlet passages 728 for fluid flow. Such a recess may be a sealed recess that can maintain pressure. For example, one or more seal elements 729 may be disposed about a cylindrical portion of the cover 780 and a wall of the recess 727 of the outlet component 726. As an example, the outlet component 726 can include the recess 727 as a partial bore, rather than a through-bore.

In the example of FIG. 8, one or more of the mating surfaces with relative movement in the system 700 may be one or more surfaces of one or more TDC components.

From the recess 727, fluid can flow toward the outer surface of the pump through a passage 708 (see also FIG. 7) and back into the wellbore. The passage 708 may be dimensioned and/or include a throttle component 709 (e.g., a choke bean or bean choke) that can add a desired amount of resistance to flow via the passage 708. During operation of the pump system 700, the pressure in the wellbore can be lower than the pressure discharged from the pump stages, during operation a differential pressure can be generated that acts to lift the rotating cap 760. A high differential pressure can cause extremely high flow rate and velocity. As an example, the throttle component 709 can have an appropriately selectable orifice that is used to regulate flow rate. Where abrasive particles or corrosive chemicals are present in the fluid flowing in the passage 708, erosion and possibly creation of a hole in the adjacent well casing may occur if the fluid is discharged in a concentrated stream (e.g., a fluid jet). To mitigate such phenomena, the passage 708 may be fit with a diffuser 711, shown as being a bell shaped component in FIG. 7, which can avoid development of a concentrated jet of fluid by diffusing fluid flow exiting the passage 708 (e.g., increasing cross-sectional flow area, etc.), as that flow may be regulated by the throttle component 709 (e.g., which may include a small orifice that increases resistance and that concentrates flow). One or more of the flow control components in the system 700 may be one or more TDC components, which can help to mitigate their erosion.

As an example, one or more of insert 783, the throttle component 709 and the diffuser 711 can be TDC components. As an example, the insert 783 can include at least its top portion being a TDC component. As an example, the throttle component 709 can include at least an orifice forming portion being a TDC component. As an example, the diffuser 711 can include at least a flow shaping portion being a TDC component. Such components may be flow regulating or flow controlling components that are associated with fluid flow that passes from the chamber 737 to the chamber 739.

As mentioned, the bearing assembly 716 may include one or more TDC components. As an example, a TDC component can be a wear and erosion resistant component. In the example of FIG. 8, one or more components of the hydraulic balance assembly 750 may be TDC components or include one or more TDC components.

Figure 9:
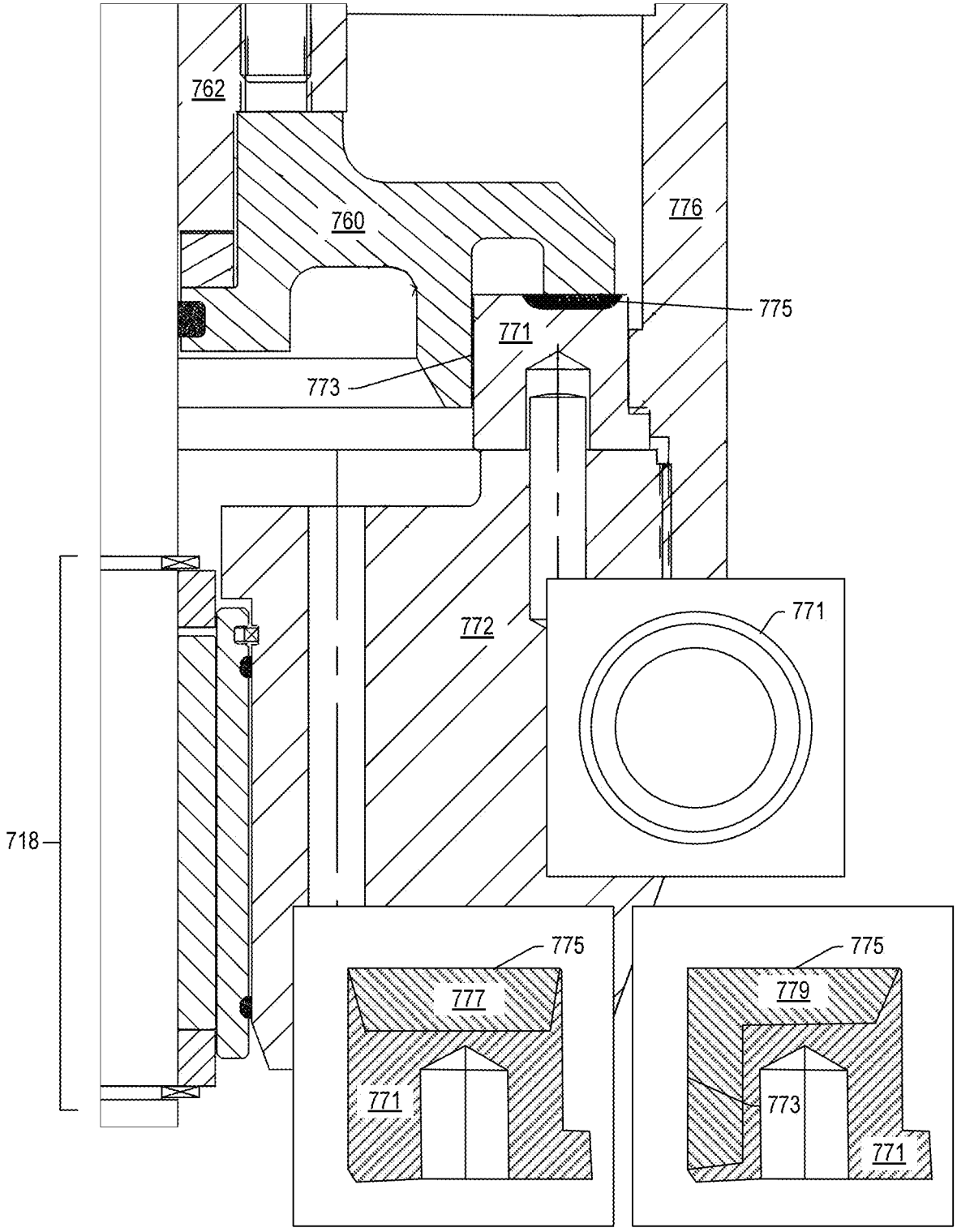
FIG. 9 illustrates a portion of the system of FIG. 7 and examples of components.

FIG. 9 shows another cross-sectional view of a portion of the system 700 that includes a portion of the hydraulic balance assembly 750. In FIG. 9, a plan view of the annular component 771 shows its ring-like structure. As an example, the annular component 771 may be a TDC component or include a TDC component. For example, consider examples where the surface 775 is part of a TDC component 777 and where the surface 775 and the surface 773 are part of a TDC component 779. As shown, the TDC component 777 may be seated in a recess of the annular component 771 or in a waterfall manner with respect to the annular component 771 as a base. As an example, one or more adhesives, interference fits, temperature-differential interference fit, etc. may be utilized to join the TDC component 777 and the component 771 or the TDC component 779 and the component 771. As an example, the annular component 771 may be a support that can be utilized to form an assembly from the annular component 771 and one or more TDC components.

Figure 10:
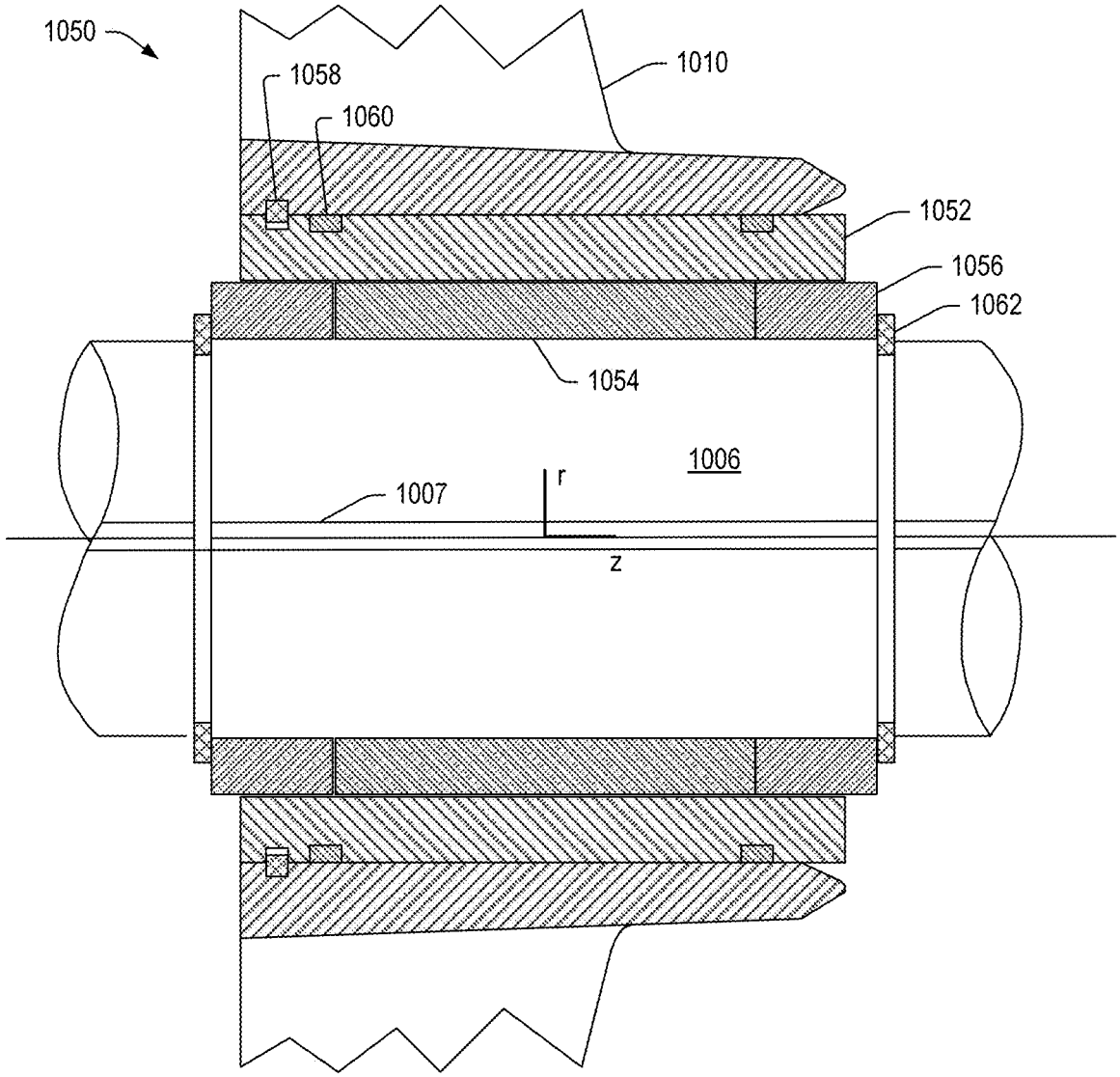
FIG. 10 illustrates an example of a bearing assembly.

FIG. 10 shows an example of a system 1000 that includes a bearing assembly 1050 that supports a shaft 1006, which may include a key and/or a keyway 1007 (e.g., to operatively coupled the shaft 1006 to one or more components). As shown, the system 1000 includes a bearing support or diffuser 1010, a bearing 1052, a sleeve 1054, spacers 1056, a retaining ring 1058, O-rings 1060, and an optional snap ring 1062, which may be utilized, for example, for heads, bases, etc. As an example, the support 1010 may be a nickel-based material. As an example, the bearing 1052 and/or the sleeve 1054 may be ceramic (e.g., zirconia, etc.) or the bearing 1052 and/or the sleeve 1054 may be a TDC component. As an example, the spacers 1056 may be a nickel-based material or may be TDC components. As an example, the snap ring 1062 may be made of an alloy such as, for example, MONEL™ alloy.

As illustrated in FIG. 10, a bearing assembly can include various components where clearances, contacts, etc. can exist between such components. Over time, one or more of the components of a bearing assembly can wear, fail, etc. For example, surfaces between the bearing 1052 and the sleeve 1054 can wear in a manner that increases clearance therebetween. In such an example, the shaft 1006 may move within that clearance to a greater extent, which may act to transmit force to the bearing 1052 and/or the sleeve 1054 that can generate further wear, etc. As an example, a system can include one or more sensors that can acquire information germane to state of one or more components of a bearing assembly, which can impact operational characteristics of a shaft and/or one or more other components As mentioned, the bearing 1052 and/or the sleeve 1054 may be a TDC component or may include a TDC component. In such examples, the TDC material can reduce wear and/or provide for one or more of reduced friction, reduced variation with respect to temperature, increased thermal conduction, etc. As an example, where thermal conduction is increased, thermal gradients may be reduced as heat energy can be transferred more readily when compared to a material of a lesser thermal conductivity.

Figure 11:
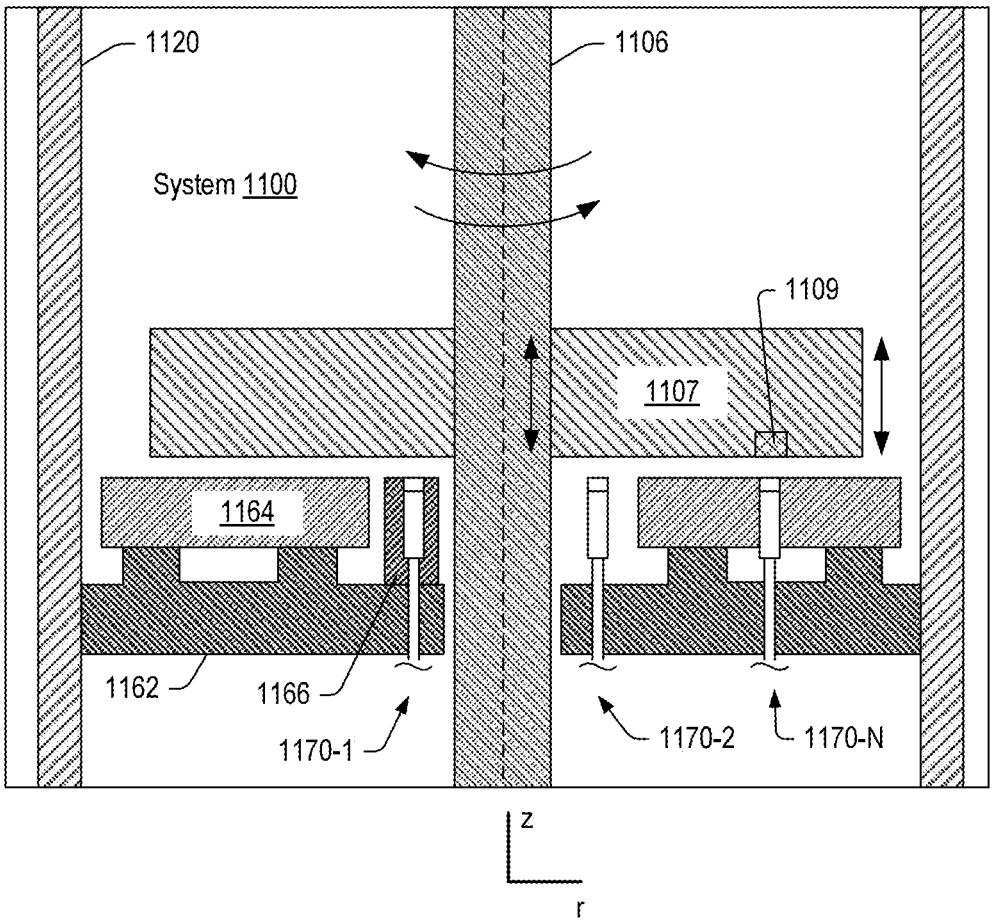
FIG. 11 illustrates an example of a thrust protection system.

FIG. 11 show an example of a system 1100 that includes a shaft 1106, a housing 1120, a runner 1107 connected to the shaft 1106 and one or more pads 1164 as attached to a support base 1162. In such an example, the system 1100 can include one or more sensors 1170-1, 1170-2 and 1170-N. A sensor may include a sensor casing 1166. As an example, the runner 1107 may include one or more targets, markers, etc. 1109. The runner 1107 and the one or more pads 1164 may be part of a thrust bearing such as the thrust bearing 375 of the protector 370 of FIG. 3.

As an example, one or more components of the system 1100 may be volumetric composite material components such as TDC components. For example, the runner 1107 may be a monolithic, unitary piece of TDC material. As an example, one or more of the pads 1164 may be monolithic, unitary pieces of TDC material. As an example, the sensor casing 1166 may be a monolithic, unitary piece of TDC material.

As an example, a thrust pad can include a sensor or sensors that can include one or more proximity sensors. In such an example, the thrust pad may be included in a housing such as, for example, a protector housing of an electric submersible pump (ESP) system. As an example, a thrust pad can be or include a TDC component.

Figure 12:
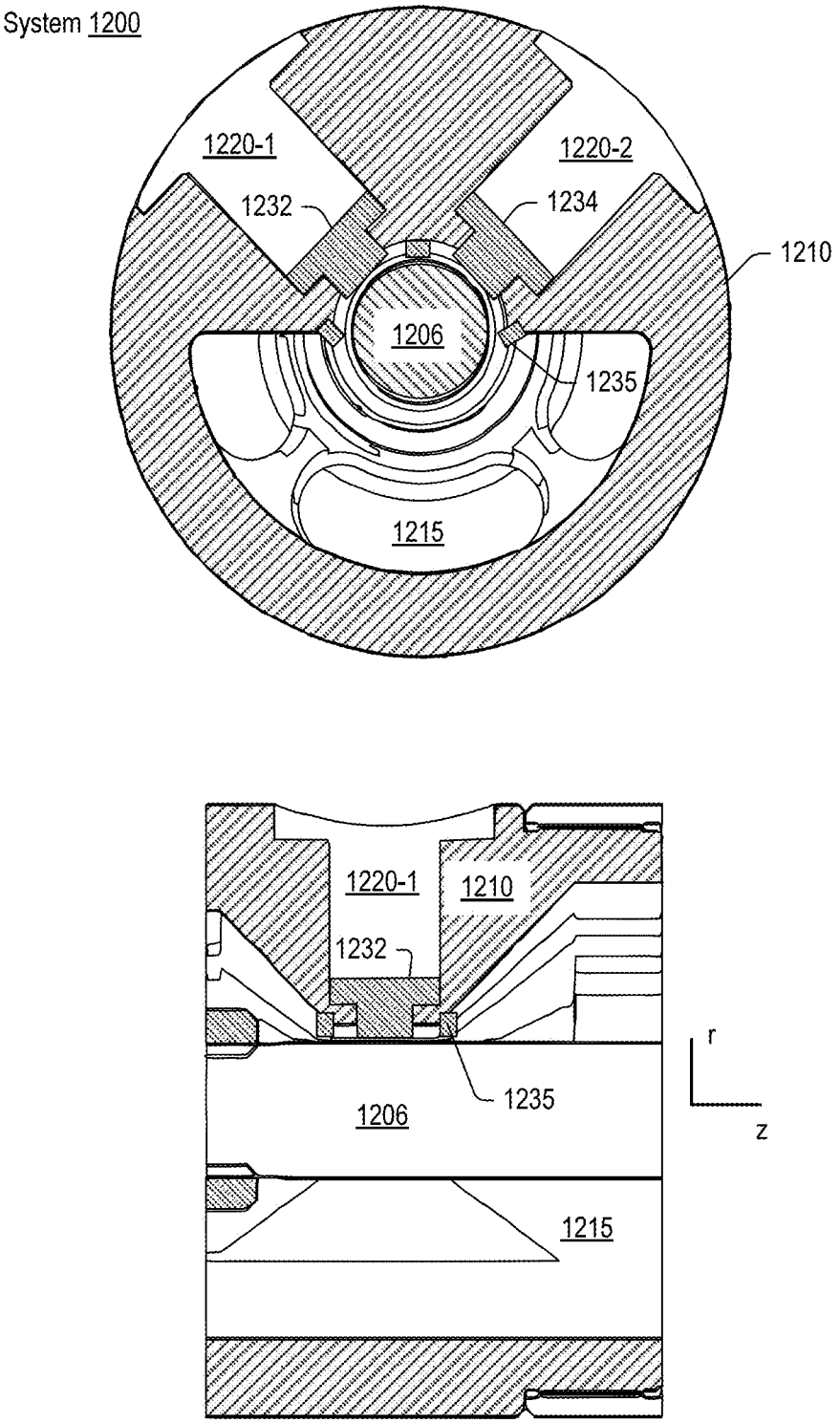
FIG. 12 illustrates an example of a system that includes examples of sensors.

FIG. 12 shows an example of a system 1200 that includes a shaft 1206 and a housing 1210 that defines flow passage(s) 1215 and recesses 1220-2 and 1220-2. In the example of FIG. 12, one or more flow protection components 1235 can be included to protect one or more sensors 1232 and 1234 (e.g., optionally set in windows, etc.) from fluid flow, which may include particulate matter (e.g., sand, etc.). As an example, a flow protection component can be a volumetric composite material component, which can be a TDC component. For example, one or more of the components 1235 can be unitary pieces of TDC material set into the housing 1210 where shape and position of the one or more components 1235 acts to direct flow and protect another component such as a sensor. In such an example, the unitary piece or pieces of TDC material may be impacted by particulate matter and divert such particulate matter away from a streamline or other type of flow that would bring the particulate matter into contact with a sensor.

As an example, a sensor can have features that protect it from the effects of internal ESP flow (e.g., flow in the flow passage(s) 1215). Such features may modify the flow pattern around a sensor to reduce wear while minimizing measurement interference. As an example, such features can be one or more of downstream, upstream or in a common radial plane of one or more sensors. As an example, features can completely or partially surround a sensor. As an example, features can be built-in to an enclosure or be separate attachments. As an example, material or materials of construction of one or more flow protection components may be a composite of polycrystalline diamond material and one or more metallic materials. For example, a sensor can include a monolithic, unitary piece of TDC material or a plurality of monolithic, unitary pieces of TDC material.

As an example, a window may be surrounded closely by a volumetric composite material, for example, a TDC component can include an opening therein that creates the window for a sensor.

As an example, a system can include a TDC sensor casing. For example, consider a sensor face that is unobstructed by conductors and protected from an environment within a housing (e.g., an ESP housing) via one or more components that can withstand pressure differences and that can withstand abrasion by particulate matter in a fluid flow stream.

As an example, a TDC component may be a solid cover that separates a sensor from an environment, which may be a well fluid environment. For example, the sensor 1232 can include a piece of TDC material that is seated in an opening of the housing 1210 that protects a sensitive portion of the sensor 1232. In such an example, the sensor 1232 can be an assembly where one or more sensor components may be assembled with one or more pieces of TDC material to form the assembly, which may be in a form ready for installation in a housing.

Figure 13:
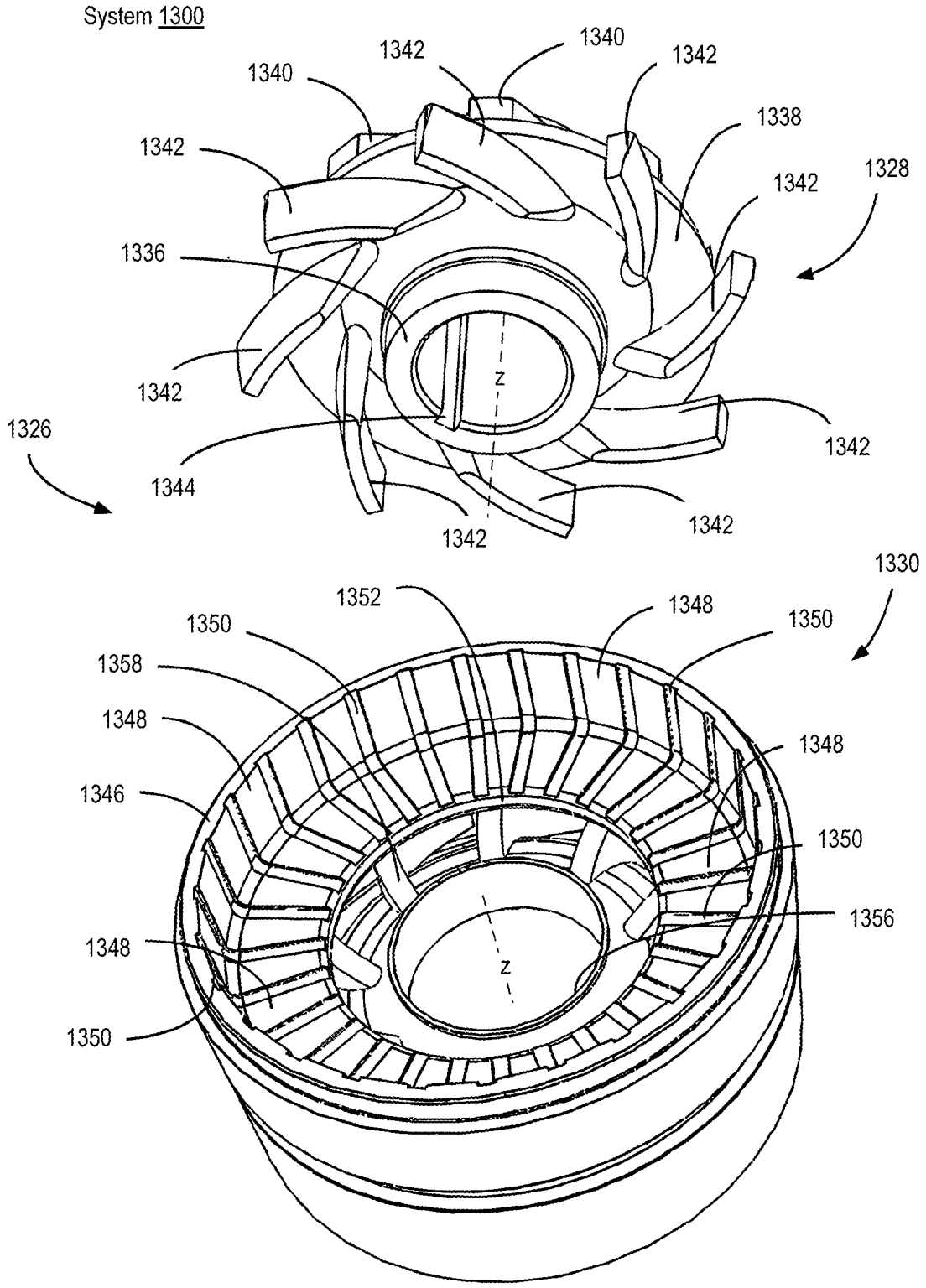
FIG. 13 illustrates an example of a conditioner assembly.

FIG. 13 shows an example of a conditioner pump assembly 1300 that may located such that output of the conditioner pump assembly 1300 feeds a pump assembly. For example, the conditioner pump assembly 1300 may function as an intake for a pump assembly. The conditioner pump assembly 1300 can be operated to pulverize and reduce the size of solid particles entrained in well fluid before the particles reach a pump assembly.

In FIG. 13, the conditioner pump assembly 1300 includes at least one conditioner pump stage 1326. The conditioner pump stage 1326 includes an impeller 1328 and a diffuser 1330. The conditioner pump assembly 1300 can also include a diffuser cap adjacent the upstream stage 1326 and a shaft (e.g., a motor driven shaft).

As each impeller 1328 rotates, it imparts kinetic energy to fluid. A portion of the kinetic force is transformed into pressure head such that the conditioner pump assembly 1300 can function as part of a centrifugal pump.

In FIG. 13, the conditioner pump stage 1326 shows the lower side of the impeller 1328 and the upper side of the diffuser 1330. The impeller 1328 includes a hub 1336, a vane support 1338, a plurality of upper vanes 1340 and a plurality of lower vanes 1342. The hub 1336 can include a slot 1344 for engagement with a corresponding key on a shaft. The vane support 1338 is connected to the hub 1336. The upper vanes 1340 and lower vanes 1342 are connected to opposite sides of the vane support 1338. The upper vanes 1340 can extend in an arcuate fashion along the top side of the vane support 1338 from the hub 1336 to the outer diameter of the vane support 1338. The lower vanes 1342 can extend in a similar arcuate fashion from the hub 1338 along the bottom side of the vane support 1338 beyond the edge of the vane support 1338. In such an example, the lower vanes 1342 can be longer than the upper vanes 1340.

The upper side of the diffuser 1330 can include a cup 1346 of sufficient size diameter and depth to accept with small tolerances the lower vanes 1342 of the impeller 1328. The surface of the cup 1346 includes a plurality of upper contact surfaces 1348 and upper flow channels 1350. The upper contact surfaces 1348 and upper flow channels 1350 cover both the horizontal and vertical surfaces of the cup 1346 in the diffuser 1330. The diffuser 1330 also includes an upper aperture 1352 disposed at the center of the bottom portion of the cup 1346.

As an example, the conditioner pump assembly 1300 can include one or more TDC components. For example, vanes or blades may be TDC vanes or TDC blades. As an example, a diffuser can include one or more pieces of TDC material. For example, surfaces where grinding occurs can be surfaces of pieces of TDC material. As an example, an impeller can include slots or other features to which TDC material vanes can be mounted where the vanes can be monolithic, unitary TDC material vanes (e.g., volumetric composite material vanes).

As an example, a pump impeller may be made entirely from TDC material, optionally as a monolithic, unitary piece, which may be referred to as a monolithic TDC impeller. As an example, a pump diffuser may be may made entirely from TDC material, optionally as a monolithic, unitary piece, which may be referred to as a monolithic TDC impeller.

Figure 14:
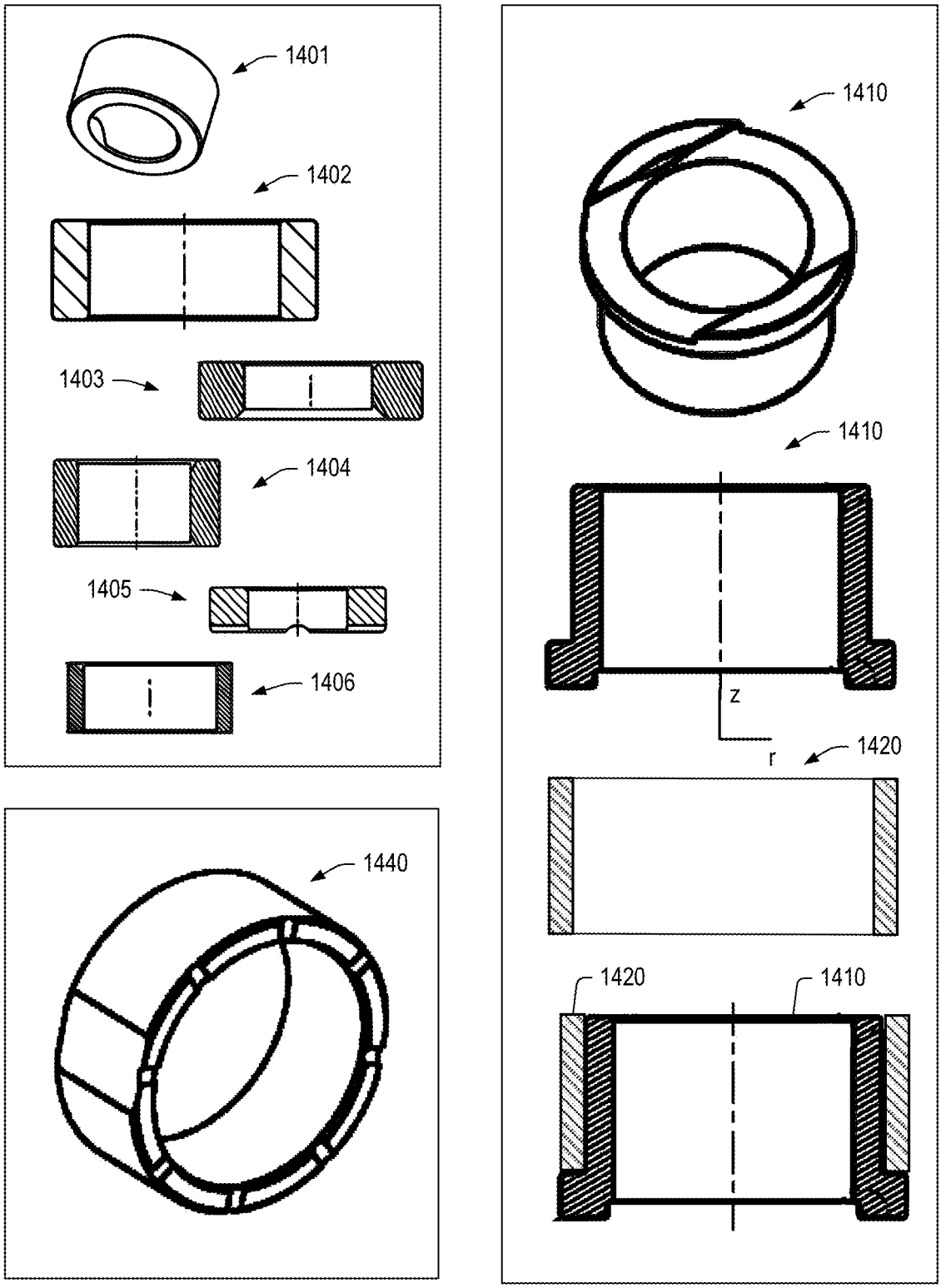
FIG. 14 illustrates various examples of components.

FIG. 14 shows various TDC components including 1401, 1402, 1403, 1404, 1405, 1406 and 1440. Such components are annular in shape and can be defined by axial and/or radial dimensions. As an example, such components may be defined by an aspect ratio. For example, the component 1403 may be of a diameter (a radial dimension) of approximately 15 and an axial dimension of approximately 4. Thus, radial dimension divided by axial dimension may be 15/4=3.75. Such a component may be defined by axial dimension divided by radial dimension as follows, 4/15=0.27. The component 1403 can be defined as having a maximum of one of the radial dimension and the axial dimension, which would be 15, and as having a minimum of one of the radial dimension and the axial dimension, which would be 4. The component 1403 can be defined as having an aspect ratio greater than approximately 1/15. For example, consider the minimum dimension 4 divided by the maximum dimension 15, which is 4/15, which is greater than approximately 1/15. In the foregoing example, the radial dimension is a diameter, which extends from a central axis along the z-direction in opposing r-directions of a cylindrical coordinate system. The aforementioned dimensions may be utilized to calculate volume of a TDC component. Or, for example, volume may be determined by one or more techniques such as displacement of fluid (e.g., displacement of water when the TDC component is submerged in water).

As an example, an aspect ratio can be of a geometric shape where its sizes are different in different dimensions. An aspect ratio may expressed as two numbers separated by a colon (x:y) or, for example, two numbers separated by a slash (x/y). The values x and y do not necessarily represent actual widths and heights but, rather, can represent a relationship between width and height. As an example, 8:5, 16:10 and 1.6:1 are three ways of representing the same aspect ratio. As an example, a widescreen TV may be 16:9 such that the width is greater than the height (e.g., an aspect ratio with a width of 16 units and height of 9 units).

As an example, an aspect ratio of 1:15 can be one unit of height to 15 units of width. Such a ratio may differential a volumetric composite material from a coating, which can be thinner, and applied in situ onto a surface.

FIG. 14 also shows components 1410 and 1420 where one of the components may be a support and where the other one of the components may be a TDC component. For example, the component 1420 may be a TDC component that is fit to the component 1410 as a support. Or, for example, the component 1410 may be a TDC component that is fit to the component 1420 as a support.

As an example, an electric submersible pump system can include a shaft; at least one impeller operatively coupled to the shaft; and a bearing assembly that rotatably supports the shaft, where at least one component of the electric submersible pump includes a volumetric composite material that includes polycrystalline diamond material and at least one metallic material. In such an example, the volumetric composite material can include a maximum dimension and a minimum dimension in a cylindrical coordinate system where the maximum dimension is less than fifteen times the minimum dimension. For example, the maximum dimension can be a radial dimension and the minimum dimension can be an axial dimension or, for example, the maximum dimension can be an axial dimension and the minimum dimension can be a radial dimension.

As an example, a bearing assembly can include a sleeve that includes a volumetric composite material where the sleeve includes a support for the volumetric composite material. Such a sleeve can be a multi-piece sleeve with a TDC material as a component that is fit to a support. As an example, a support may be a metallic support or, for example, a support may be a ceramic support.

As an example, a bearing assembly can include a bearing that includes a volumetric composite material where the bearing includes a support for the volumetric composite material. Such a sleeve can be a multi-piece sleeve with a TDC material as a component that is fit to a support. As an example, a support may be a metallic support or, for example, a support may be a ceramic support.

As an example, a volumetric composite material can be impregnated with lubricant. In such an example, the impregnated lubricant can be at least in part disposed in surface features of the volumetric composite material. Such surface features can be surface pores and/or surface roughness.

As an example, a bearing assembly can include a sleeve and a bearing where the sleeve is a volumetric composite material (e.g., a TDC material).

As an example, a bearing assembly can include a sleeve and a bearing where the bearing includes a volumetric composite material (e.g., a TDC material).

As an example, an electric submersible pump system can include a plurality of bearing assemblies where at least one may include one or more TDC components.

As an example, a volumetric composite material can include at least 70 percent polycrystalline diamond material by volume. As an example, a volumetric composite material can have a volume of at least approximately 0.15 cubic inches (e.g., at least approximately 2.4 $cm^3$) and a minimum dimension that is at least 1/15th of a maximum dimension. Such a volumetric composite material can be a unitary mass. As an example, a unitary component made of a volumetric composite material can be defined with respect to a coordinate system, which may be, for example, Cartesian, cylindrical, spherical or another type of coordinate system.

As an example, an electric submersible pump system can include a conditioner assembly where the conditioner assembly includes one or more pieces of volumetric composite material that include polycrystalline diamond material and at least one metallic material.

As an example, an electric submersible pump system can include a sensor and a sensor casing where the sensor and/or the sensor casing includes at least one piece of volumetric composite material that includes polycrystalline diamond material and at least one metallic material.

As an example, an electric submersible pump system can include a flow diverter adjacent to a sensor where the flow diverter includes at least one piece of volumetric composite material that includes polycrystalline diamond material and at least one metallic material.

As an example, an electric submersible pump system can include a hydraulic balance system in which at least one component controlling flow and pressure includes a volumetric composite material that includes polycrystalline diamond material and at least one metallic material.

As an example, an electric submersible pump system can include a submersible electric motor operatively coupled to a shaft.

As an example, one or more methods described herein may include associated computer-readable storage media (CRM) blocks. Such blocks can include instructions suitable for execution by one or more processors (or cores) to instruct a computing device or system to perform one or more actions. As an example, a computer-readable storage medium may be a storage device that is not a carrier wave (e.g., a non-transitory storage medium that is not a carrier wave).

Figure 15:
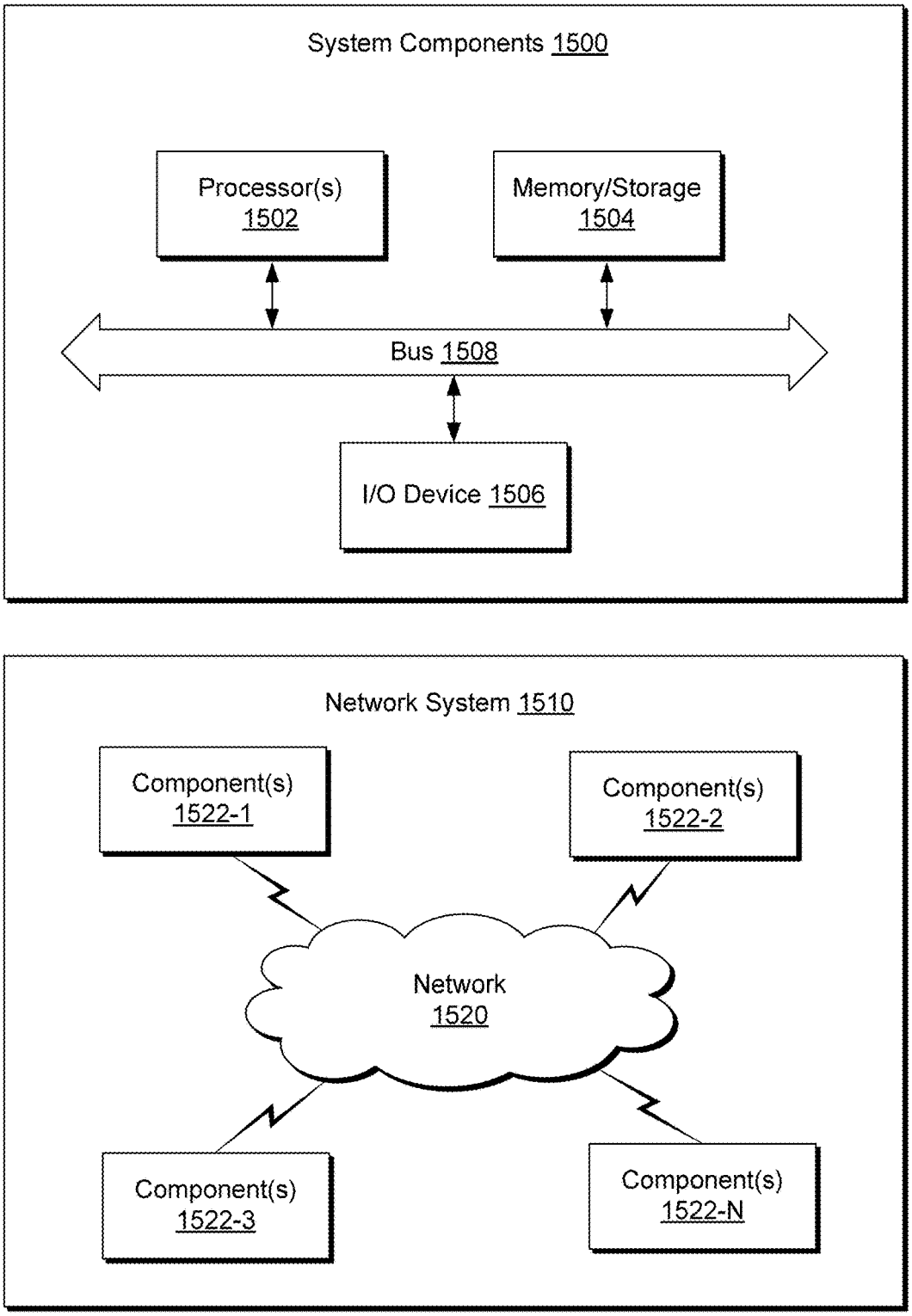
FIG. 15 illustrates example components of a system and a networked system.

FIG. 15 shows components of a computing system 1500 and a networked system 1510. The system 1500 includes one or more processors 1502, memory and/or storage components 1504, one or more input and/or output devices 1506 and a bus 1508. According to an embodiment, instructions may be stored in one or more computer-readable media (e.g., memory/storage components 1504). Such instructions may be read by one or more processors (e.g., the processor(s) 1502) via a communication bus (e.g., the bus 1508), which may be wired or wireless. The one or more processors may execute such instructions to implement (wholly or in part) one or more attributes (e.g., as part of a method). A user may view output from and interact with a process via an I/O device (e.g., the device 1506). According to an embodiment, a computer-readable medium may be a storage component such as a physical memory storage device, for example, a chip, a chip on a package, a memory card, etc.

According to an embodiment, components may be distributed, such as in the network system 1510. The network system 1510 includes components 1522-1, 1522-2, 1522-3, . . . , 1522-N. For example, the components 1522-1 may include the processor(s) 1502 while the component(s) 1522-3 may include memory accessible by the processor(s) 1502. Further, the component(s) 1522-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An electric submersible pump system comprising:

a shaft;

at least one impeller operatively coupled to the shaft;

at least one bearing assembly that rotatably supports the shaft, wherein at least one monolithic component of the electric submersible pump system comprises a volumetric composite material that comprises polycrystalline diamond material and at least one metallic material; and a flow diverter adjacent to a sensor, wherein the flow diverter comprises the volumetric composite material that comprises polycrystalline diamond material and at least one metallic material.

2. The electric submersible pump system of claim 1 wherein the volumetric composite material comprises a maximum dimension and a minimum dimension in a cylindrical coordinate system wherein the maximum dimension is less than fifteen times the minimum dimension.

3. The electric submersible pump system of claim 2 wherein the maximum dimension comprises a radial dimension and wherein the minimum dimension comprises an axial dimension.

4. The electric submersible pump system of claim 2 wherein the maximum dimension comprises an axial dimension and wherein the minimum dimension comprises a radial dimension.

5. The electric submersible pump system of claim 1 wherein the bearing assembly comprises a sleeve that comprises the volumetric composite material and wherein the sleeve comprises a support for the volumetric composite material.

6. The electric submersible pump system of claim 5 wherein the support comprises a metallic support or a ceramic support.

7. The electric submersible pump system of claim 1 wherein the bearing assembly comprises a bearing that comprises the volumetric composite material and wherein the bearing comprises a support for the volumetric composite material.

8. The electric submersible pump system of claim 7 wherein the support comprises a metallic support or a ceramic support.

9. The electric submersible pump system of claim 1 wherein the volumetric composite material comprises impregnated lubricant.

10. The electric submersible pump system of claim 9 wherein the impregnated lubricant is disposed in surface features of the volumetric composite material.

11. The electric submersible pump system of claim 1 wherein the at least one bearing assembly comprises a plurality of bearing assemblies that rotatably support the shaft.

12. The electric submersible pump system of claim 1 wherein the volumetric composite material comprises at least 70 percent polycrystalline diamond material by volume.

13. The electric submersible pump system of claim 1 wherein the volumetric composite material comprises a volume of at least approximately 0.15 cubic inches and a minimum dimension that is at least $1/15^{th}$ of a maximum dimension.

14. The electric submersible pump system of claim 1 comprising a conditioner assembly wherein the conditioner assembly comprises the volumetric composite material that comprises polycrystalline diamond material and at least one metallic material.

15. The electric submersible pump system of claim 1 comprising a submersible pump that comprises a submersible electric motor operatively coupled to the shaft.

16. An electric submersible pump system comprising:

a shaft;

at least one impeller operatively coupled to the shaft;

a bearing assembly that rotatably supports the shaft; and a sensor and a sensor casing comprising a volumetric composite material that comprises polycrystalline diamond material and at least one metallic material.

17. The electric submersible pump system of claim 16 wherein the bearing assembly comprises a sleeve and a bearing, wherein the sleeve and/or bearing comprises the volumetric composite material.

18. An electric submersible pump system comprising:

a shaft;

at least one impeller operatively coupled to the shaft;

a bearing assembly that rotatably supports the shaft; and a hydraulic balance system wherein at least one component controls flow and pressure and comprises a volumetric composite material that comprises polycrystalline diamond material and at least one metallic material.

19. The electric submersible pump system of claim 18 wherein the bearing assembly comprises a sleeve and a bearing, wherein the sleeve and/or bearing comprises the volumetric composite material.

* * * * *